US010074477B2

(12) United States Patent
Nagata et al.

(10) Patent No.: US 10,074,477 B2
(45) Date of Patent: Sep. 11, 2018

(54) RARE EARTH SINTERED MAGNET AND MAKING METHOD

(71) Applicant: SHIN-ETSU CHEMICAL CO., LTD., Tokyo (JP)

(72) Inventors: Hiroaki Nagata, Echizen (JP); Yuuji Gouki, Echizen (JP); Kazuaki Sakaki, Echizen (JP); Tadao Nomura, Echizen (JP); Koichi Hirota, Echizen (JP); Hajime Nakamura, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 15/375,655

(22) Filed: Dec. 12, 2016

(65) Prior Publication Data

US 2017/0098503 A1 Apr. 6, 2017

Related U.S. Application Data

(62) Division of application No. 13/860,587, filed on Apr. 11, 2013, now abandoned.

(30) Foreign Application Priority Data

Apr. 11, 2012 (JP) ..... 2012-090070
Apr. 11, 2012 (JP) ..... 2012-090078
Apr. 11, 2012 (JP) ..... 2012-090099

(51) Int. Cl.

| | |
|---|---|
| ***H01F 1/057*** | (2006.01) |
| ***H01F 41/02*** | (2006.01) |
| ***H01F 1/053*** | (2006.01) |
| ***B22F 3/10*** | (2006.01) |
| ***B22F 3/26*** | (2006.01) |
| ***C22C 38/60*** | (2006.01) |
| ***C22C 38/20*** | (2006.01) |
| ***C22C 38/16*** | (2006.01) |
| ***C22C 38/14*** | (2006.01) |
| ***C22C 38/12*** | (2006.01) |
| ***C22C 38/10*** | (2006.01) |
| ***C22C 38/06*** | (2006.01) |
| ***C22C 38/00*** | (2006.01) |
| ***C22C 38/02*** | (2006.01) |
| ***C22C 38/04*** | (2006.01) |
| ***C21D 6/00*** | (2006.01) |
| *B22F 3/24* | (2006.01) |

(52) U.S. Cl.

CPC ..... *H01F 41/0293* (2013.01); *B22F 3/1017* (2013.01); *B22F 3/26* (2013.01); *C21D 6/004* (2013.01); *C21D 6/005* (2013.01); *C21D 6/007* (2013.01); *C21D 6/008* (2013.01); *C22C 38/002* (2013.01); *C22C 38/005* (2013.01); *C22C 38/007* (2013.01); *C22C 38/008* (2013.01); *C22C 38/02* (2013.01); *C22C 38/04* (2013.01); *C22C 38/06* (2013.01); *C22C 38/105* (2013.01); *C22C 38/12* (2013.01); *C22C 38/14* (2013.01); *C22C 38/16* (2013.01); *C22C 38/20* (2013.01); *C22C 38/60* (2013.01); *H01F 1/0536* (2013.01); *H01F 41/0266* (2013.01); *B22F 2003/248* (2013.01); *B22F 2301/35* (2013.01); *B22F 2998/10* (2013.01)

(58) Field of Classification Search

CPC ..... H01F 41/0266; H01F 1/0536
See application file for complete search history.

(56) References Cited

U.S. PATENT DOCUMENTS

| | | | |
|---|---|---|---|
| 7,824,506 | B2 | 11/2010 | Machida et al. |
| 7,883,587 | B2 | 2/2011 | Nakamura et al. |
| 7,985,303 | B2 | 7/2011 | Nagata et al. |
| 8,206,516 | B2 | 6/2012 | Yoshimura et al. |
| 8,211,327 | B2 | 7/2012 | Nakamura et al. |
| 8,231,740 | B2 | 7/2012 | Nakamura et al. |
| 8,257,511 | B2 | 9/2012 | Nagata et al. |
| 8,394,450 | B2 | 3/2013 | Baba et al. |
| 2004/0094237 | A1 | 5/2004 | Nomura et al. |
| 2007/0240789 | A1 | 10/2007 | Nakamura et al. |
| 2009/0032147 | A1 | 2/2009 | Nozawa et al. |
| 2009/0098006 | A1 | 4/2009 | Nakamura et al. |
| 2009/0226339 | A1 | 9/2009 | Nakamura et al. |

(Continued)

FOREIGN PATENT DOCUMENTS

| | | | |
|---|---|---|---|
| EP | 1890301 | A1 | 2/2008 |
| EP | 1900462 | A1 | 3/2008 |

(Continued)

OTHER PUBLICATIONS

K.T. Park et al., "Effect of Metal-Coating and Consecutive Heat Treatment on Coercivity of Thin Nd—Fe—B Sintered Magnets", Proceedings of the Sixteen International Workshop on Rare-Earth Magnets and Their Applications, Sendai, pp. 257-264 (2000).

S. Suzuki et al., "Development and Application of High Performance Minute Rare Earth Magnet", Material Integration, vol. 16, pp. 17-22, (2003).

Y. Takada et al., "Effect of Dy Diffusion Treatment on Coercivity of Nd—Fe—B Magnet", Proceedings of Japan Society of Power & Powder Metallurgy, 2010 Spring Meeting (2010); p. 92 (with English tranbslation 1 page).

*Primary Examiner* — Jessee Roe

(74) *Attorney, Agent, or Firm* — Westerman, Hattori, Daniels & Adrian, LLP

(57) ABSTRACT

A rare earth sintered magnet is an anisotropic sintered body comprising $Nd_2Fe_{14}B$ crystal phase as primary phase and having the composition $R^1{}_aT_bM_cSi_dB_e$ wherein $R^1$ is a rare earth element inclusive of Sc and Y, T is Fe and/or Co, M is Al, Cu, Zn, In, P, S, Ti, V, Cr, Mn, Ni, Ga, Ge, Zr, Nb, Mo, Pd, Ag, Cd, Sn, Sb, Hf, Ta, or W, "a" to "e" are $12 \leq a \leq 17$, $0 \leq c \leq 10$, $0.3 \leq d \leq 7$, $5 \leq e \leq 10$, and the balance of b, wherein Dy and/or Tb is diffused into the sintered body from its surface.

8 Claims, 4 Drawing Sheets

(56) References Cited

U.S. PATENT DOCUMENTS

| | | | |
|---|---|---|---|
| 2010/0282371 | A1 | 11/2010 | Sagawa et al. |
| 2011/0279205 | A1 | 11/2011 | Fukui et al. |
| 2012/0114515 | A1 | 5/2012 | Kaneko et al. |
| 2014/0132377 | A1 | 5/2014 | Nakajima et al. |

FOREIGN PATENT DOCUMENTS

| | | | |
|---|---|---|---|
| JP | 2853838 | B2 | 2/1999 |
| JP | 2004-165482 | A | 6/2004 |
| JP | 2008/147634 | A | 6/2006 |
| JP | 2007-287875 | A | 11/2007 |
| JP | 2008-263179 | A | 10/2008 |
| JP | 2009-054754 | A | 3/2009 |
| JP | 4241890 | B2 | 3/2009 |
| JP | 2009-224413 | A | 10/2009 |
| JP | 2009-260338 | A | 11/2009 |
| JP | 2009-289994 | A | 12/2009 |
| JP | 4450239 | B2 | 4/2010 |
| JP | 4548673 | B2 | 9/2010 |
| JP | 2011-82467 | A | 4/2011 |
| JP | 2011-258935 | A | 12/2011 |
| JP | 2014-205918 | A | 10/2014 |
| WO | 2007/119551 | A | 10/2007 |
| WO | 2008/023731 | A1 | 2/2008 |
| WO | 2009/087975 | A1 | 7/2009 |

OTHER PUBLICATIONS

N. Oono et al., "Study on Microstructure of Neodymium Magnet Subjected to Dy Modification Treatment", Proceedings of Japan Instituted of Metals, 2009 Spring Meeting, p. 115 ( with English translation 1 page).

K. Machida et al., "Grain Boundary Modification and Magnetic Properties of Nd—Fe—B sintered Magnets", Proceedings of Japan Society of Powder & Powder Metallurgy, 2004 Spring Meeting; p. 202 ( With English translation pp. 1-2).

K. Machida et al., "Preparation of High-Coercivity Nd—Fe—B Sintered Magnet by Metal Vapor Sorption and Evaluation", Proceedings of teh 32nd Meeting of Japan Society of Magnetism (2008), p. 375 (with English translation 1 page).

K. Machida et al., "Coercivity Enhancement of Nd—Fe—B Sintered Magnet by Grain Boundary Modification Using Rare Earth Metal Fine Powder", Proceedings of Japan Institute of Metals, 2009 Spring Meeting, p. 279 (with English translation 1 page).

Office Action dated Apr. 26, 2016, issued in counterpart Japanese application No. 2013-081972.

Office Action dated Aug. 30, 2016, issued in counterpart Japanese Application No. 2013-081972.

Extended European Search Report dated Oct. 26, 2017, issued in Application No. 13163177.2.

RARE EARTH SINTERED MAGNET AND MAKING METHOD

CROSS-REFERENCE TO RELATED APPLICATION

This application is a divisional of U.S. application Ser. No. 13/860,587, now abandoned, filed on Apr. 11, 2013, which claims priority under 35 U.S.C. § 119(a) on Japanese Patent Application No. 2012-090070 filed on Apr. 11, 2012, Japanese Patent Application No. 2012-090078 filed on Apr. 11, 2012, and Japanese Patent Application No. 2012-090099 filed on Apr. 11, 2012, the entire contents of which are hereby incorporated by is reference.

TECHNICAL FIELD

This invention relates to high-performance rare earth sintered magnets with minimal contents of expensive Tb and Dy, and a method for preparing the same.

BACKGROUND ART

Over the years, Nd—Fe—B sintered magnets find an ever increasing range of application including hard disk drives, air conditioners, industrial motors, power generators and drive motors in hybrid cars and electric vehicles. When used in air conditioner compressor motors, vehicle-related components and other applications which are expected of future development, the magnets are exposed to elevated temperatures. Thus the magnets must have stable properties at elevated temperatures, that is, be heat resistant. The addition of Dy and Tb is essential to this end whereas a saving of Dy and Tb is an important task when the tight resource problem is considered.

For the relevant magnet based on the magnetism-governing primary phase of $Nd_2Fe_{14}B$ crystal grains, small domains which are reversely magnetized, known as reverse magnetic domains, are created at interfaces of $Nd_2Fe_{14}B$ crystal grains. As these domains grow, magnetization is reversed. In theory, the maximum coercive force is equal to the anisotropic magnetic field (6.4 MA/m) of $Nd_2Fe_{14}B$ compound. However, because of a reduction of the anisotropic magnetic field caused by disorder of the crystal structure near grain boundaries and the influence of leakage magnetic field caused by morphology or the like, the coercive force actually available is only about 15% (1 MA/m) of the anisotropic magnetic field.

It is known that the anisotropic magnetic field of $Nd_2Fe_{14}B$ is significantly enhanced when Nd sites are substituted by Dy or Tb. Accordingly, substitution of Dy or Tb for part of Nd leads to an enhanced anisotropic magnetic field and hence, an increased coercive force. However, since Dy and Tb cause a significant loss of saturation magnetization polarization of magnetic compounds, an attempt to increase the coercive force by addition of these elements is inevitably followed by a decline of remanence (or residual magnetic flux density). That is, a tradeoff between coercivity and remanence is unavoidable.

When the magnetization reversal mechanism as mentioned above is considered, if part of Nd is substituted by Dy or Tb only in proximity to primary phase grain boundaries where reverse magnetic domains are created, then only a low content of heavy rare earth element can increase the coercive force while minimizing a decline of remanence. Based on this idea, a method of preparing an Nd—Fe—B magnet known as two-alloy method was developed (see JP 2853838). The method involves separately preparing an alloy having a composition approximate to $Nd_2Fe_{14}B$ compound and a sintering aid alloy having Dy or Tb added thereto, grinding and mixing them, and sintering the mixture. However, since the sintering temperature is as high as 1,050 to 1,100° C., Dy or Tb is diffused inward of primary phase crystal grains of about 5 to 10 μm from their interface to a depth of about 1 to 4 μm, with a concentration difference from the center of primary phase crystal grains being not so large. For achieving a higher coercive force and remanence, it is ideal that heavy rare earth element be enriched in a higher concentration in a thinner diffusion region. It is important for heavy rare earth element to diffuse at lower temperature. To overcome this problem, the grain boundary diffusion method to be described below was developed.

In the literature, the phenomenon was discovered in 2000 that when a thin magnet piece of 50 μm is coated with Dy by sputtering and heat treated at 800° C. so that Dy is enriched in grain boundary phase, the coercivity is increased without a substantial loss of remanence. See K. T. Park, K. Hiraga and M. Sagawa, "Effect of Metal-Coating and Consecutive Heat Treatment on Coercivity of Thin Nd—Fe—B Sintered Magnets," Proceedings of the Sixteenth International Workshop on Rare-Earth Magnets and Their Applications, Sendai, p. 257 (2000). The same phenomenon was confirmed in 2003 when a magnet body of several millimeters thick was coated with Tb by three-dimensional sputtering. That is, the phenomenon is applicable to magnet bodies of practically acceptable size. See S. Suzuki and K. Machida, "Development and Application of High-Performance Minute Rare Earth Magnets," Material Integration, 16, 17-22 (2003); and K. Machida, N. Kawasaki, S. Suzuki, M. Ito and T. Horikawa, "Grain Boundary Modification and Magnetic Properties of Nd—Fe—B Sintered Magnets," Proceedings of Japan Society of Powder & Powder Metallurgy, 2004 Spring Meeting, p. 202. These methods based on grain boundary diffusion involve once preparing a sintered body, supplying Dy or Tb to the surface of the sintered body, letting the heavy rare earth element diffuse into the sintered body through the grain boundary phase which is a liquid phase at a temperature lower than the sintering temperature, for thereby substituting a high concentration of Dy or Tb for Nd only in proximity to the surface of primary phase crystal grains.

In the case of coating, typically three-dimensional coating, by sputtering, a relatively large size system is necessary. Feeds to the system must be fully clean. After the system is charged, a high vacuum must be maintained. The coating step is thus a time and labor-consuming operation including the time taken until the predetermined thickness is reached. Since magnet pieces having metallic Dy or Tb coated by sputtering tend to fuse together, they must be spaced apart during heat treatment for diffusion. It is difficult to charge the heat treatment furnace with the number of magnet pieces compliant with its capacity, resulting in low productivity.

Various modifications of the grain boundary diffusion method have been proposed for mass-scale production. These methods differ mainly in the supply of Dy or Tb (to be diffused) to the magnet. The inventors previously proposed in JP 4450239 (WO 2006/043348) a method involving immersing a sintered body in a slurry of a powder fluoride or oxide of Dy or Tb in water or organic solvent, taking out the sintered body, drying and heat treating for diffusion. During the heat treatment, the Nd-rich grain boundary phase is melted and part thereof is diffused to the sintered body surface, with substitution reaction between Nd and Dy/Tb taking place between the diffused part and the coated powder, through which Dy/Tb is incorporated into the magnet.

Besides, a method involving mixing Dy or Tb fluoride with calcium hydride, coating the mixture, heat treating for thereby reducing the fluoride into the metal and letting the metal diffuse is proposed in JP 4548673 (WO 2006/064848). Another method involves admitting Dy metal/alloy to a heat treating box, and effecting diffusion treatment for letting Dy vapor diffuse into the magnet as disclosed in JP 4241890, WO 2008/023731; K. Machida, S. Shu, T. Horikawa, and T. Lee, "Preparation of High-Coercivity Nd—Fe—B Sintered Magnet by Metal Vapor Sorption and Evaluation," Proceedings of the 32nd Meeting of Japan Society of Magnetism, 375 (2008); Y. Takada, K. Fukumoto, and Y. Kaneko "Effect of Dy Diffusion Treatment on Coercivity of Nd—Fe—B Magnet," Proceedings of Japan Society of Powder & Powder Metallurgy, 2010 Spring Meeting, p. 92 (2010); K. Machida, T. Nishimoto, T. Lee, T. Horikawa and M. Ito, "Coercivity Enhancement of Nd—Fe—B Sintered Magnet by Grain Boundary Modification Using Rare Earth Metal Fine Powder", Proceedings of Japan Institute of Metals, 2009 Spring Meeting, 279 (2009). Coating of metal powder (metal element, hydride or alloy) is disclosed in JP-A 2007-287875, JP-A 2008-263179, JP-A 2009-289994, WO 2009/087975, and N. Ono, R. Kasada, H. Matsui, A. Kouyama, F. Imanari, T. Mizoguchi and M. Sagawa, "Study on Microstructure of Neodymium Magnet Subjected to Dy Modification Treatment," Proceedings of Japan Instituted of Metals, 2009 Spring Meeting, 115 (2009).

Studies are also made on the mother alloy amenable to coercivity improvement by grain boundary diffusion, that is, anisotropic sintered body prior to grain boundary diffusion. The inventors discovered in JP-A 2008-147634 that a significant coercivity enhancement effect is achievable by providing Dy/Tb diffusion routes. Based on the belief that potential reaction of diffused heavy rare earth element with Nd oxide within the magnet causes to reduce the diffusion amount, it was proposed in JP-A 2011-82467 to gain a certain diffusion amount by previously adding fluorine to the mother alloy to convert the oxide to oxyfluoride for reducing reactivity with Dy/Tb. It has never been proposed to improve diffusion efficiency while paying attention to the chemical properties of the Nd—rich grain boundary phase affording diffusion routes or the $Nd_2Fe_{14}B$ compound eventually undergoing substitution reaction on the surface.

DISCLOSURE OF INVENTION

An object of the invention is to provide a rare earth sintered magnet and a method for preparing the same, specifically a method for easily preparing a high-performance R—Fe—B sintered magnet (wherein R is at least one rare earth element inclusive of Sc and Y) with minimal usage of Tb or Dy and exhibiting a high coercivity.

Performing experiments by adding various elements to R—Fe—B sintered magnets (wherein R is at least one rare earth element inclusive of Sc and Y), typically Nd—Fe—B sintered magnets so as to alter the chemical properties of the Nd—rich grain boundary phase and $Nd_2Fe_{14}B$ compound, and examining their influence on the coercivity enhancement by grain boundary diffusion, the inventors have found that the coercivity enhancement by grain boundary diffusion treatment is significantly improved by the addition of 0.3 to 7 at % of silicon to the mother alloy, and that the optimum temperature spans for grain boundary diffusion treatment and subsequent aging treatment are spread by the addition of 0.3 to 10 at % of aluminum.

In a first aspect, the invention provides a rare earth sintered magnet in the form of an anisotropic sintered body comprising $Nd_2Fe_{14}B$ crystal phase as primary phase and having the composition $R^1{}_aT_bM_cSi_dB_e$ wherein $R^1$ is at least one element selected from rare earth elements inclusive of Sc and Y, T is one or both of Fe and Co, M is at least one element selected from the group consisting of Al, Cu, Zn, In, P, S, Ti, V, Cr, Mn, Ni, Ga, Ge, Zr, Nb, Mo, Pd, Ag, Cd, Sn, Sb, Hf, Ta, and W, Si is silicon, B is boron, "a" to "e" indicative of atomic percent in the alloy are in the range: $12 \le a \le 17$, $0 \le c \le 10$, $0.3 \le d \le 7$, $5 \le e \le 10$, and the balance of b, wherein $R^2$ which is one or both of Dy and Tb is diffused into the anisotropic sintered body from its surface.

Preferably, $R^1$ contains at least 80 at % of Nd and/or Pr. Also preferably, T contains at least 85 at % of Fe.

In a second aspect, the invention provides a method for preparing a rare earth sintered magnet, comprising the steps of:

providing an anisotropic sintered body comprising $Nd_2Fe_{14}B$ crystal phase as primary phase and having the composition $R^1{}_aT_bM_cSi_dB_e$ wherein $R^1$ is at least one element selected from rare earth elements inclusive of Sc and Y, T is one or both of Fe and Co, M is at least one element selected from the group consisting of Al, Cu, Zn, In, P, S, Ti, V, Cr, Mn, Ni, Ga, Ge, Zr, Nb, Mo, Pd, Ag, Cd, Sn, Sb, Hf, Ta, and W, Si is silicon, B is boron, "a" to "e" indicative of atomic percent in the alloy are in the range: $12 \le a \le 17$, $0 \le c \le 10$, $0.3 \le d \le 7$, $5 \le e \le 10$, and the balance of b, disposing an element $R^2$ or an $R^2$-containing substance on a surface of the anisotropic sintered body, $R^2$ being one or both of Dy and Tb, and effecting heat treatment for diffusion at a temperature lower than or equal to the sintering temperature of the sintered body for causing element $R^2$ to diffuse into the sintered body from its surface.

Preferably, $R^1$ contains at least 80 at % of Nd and/or Pr. Also preferably, T contains at least 85 at % of Fe.

The method may further comprise, after the step of heat treatment at a temperature lower than or equal to the sintering temperature of the sintered body for causing $R^2$ to diffuse into the sintered body, the step of effecting aging treatment at a lower temperature.

In a preferred embodiment, the step of disposing element $R^2$ or $R^2$-containing substance on a surface of the anisotropic sintered body includes coating the sintered body surface with a member selected from the group consisting of a powder oxide, fluoride, oxyfluoride or hydride of $R^2$, a powder of $R^2$ or $R^2$-containing alloy, a sputtered or evaporated film of $R^2$ or $R^2$-containing alloy, and a powder mixture of a fluoride of $R^2$ and a reducing agent.

In a preferred embodiment, the step of disposing element $R^2$ or $R^2$-containing substance on a surface of the anisotropic sintered body includes contacting a vapor of $R^2$ or $R^2$-containing alloy with the sintered body surface.

Preferably, the $R^2$-containing substance contains at least 30 at % of $R^2$.

In a third aspect, the invention provides a method for preparing a rare earth sintered magnet, comprising the steps of:

providing an anisotropic sintered body comprising $Nd_2Fe_{14}B$ crystal phase as primary phase and having the composition $R^1{}_aT_bM_cAl_fSi_dB_e$ wherein $R^1$ is at least one element selected from rare earth elements inclusive of Sc and Y, T is one or both of Fe and Co, M is at least one element selected from the group consisting of Cu, Zn, In, P, S, Ti, V, Cr, Mn, Ni, Ga, Ge, Zr, Nb, Mo, Pd, Ag, Cd, Sn, Sb, Hf, Ta, and W, Al is aluminum, Si is silicon, B is boron, "a" to "f" indicative of atomic percent in the alloy are in the range: $12 \leq a \leq 17$, $0 \leq c \leq 5$, $0.3 \leq f \leq 10$, $0.3 \leq d \leq 7$, $5 \leq e \leq 10$, and the balance of b, and causing element $R^2$ to diffuse into the sintered body from its surface at a temperature lower than or equal to the sintering temperature of the sintered body, wherein $R^2$ is one or both of Dy and Tb.

Preferably, the diffusion temperature is 800 to 1,050° C., more preferably 850 to 1,000° C.

The method may further comprise the step of effecting aging treatment after the step of causing element $R^2$ to diffuse into the sintered body.

The aging treatment is preferably at a temperature of 400 to 800° C., more preferably 450 to 750° C.

Preferably R contains at least 80 at % of Nd and/or Pr. Also preferably, T contains at least 85 at % of Fe.

In a fourth aspect, the invention provides a rare earth sintered magnet in the form of an anisotropic sintered body comprising $Nd_2Fe_{14}B$ crystal phase as primary phase and having the composition $R^1{}_aT_bAl_fSi_dB_e$ wherein $R^1$ is at least one element selected from rare earth elements inclusive of Sc and Y, T is one or both of Fe and Co, M is at least one element selected from the group consisting of Cu, Zn, In, P, S, Ti, V, Cr, Mn, Ni, Ga, Ge, Zr, Nb, Mo, Pd, Ag, Cd, Sn, Sb, Hf, Ta, and W, Al is aluminum, Si is silicon, B is boron, "a" to "f" indicative of atomic percent in the alloy are in the range: $12 \leq a \leq 17$, $0 \leq c \leq 5$, $0.3 \leq f \leq 10$, $0.3 \leq d \leq 7$, $5 \leq e \leq 10$, and the balance of b, wherein Tb is diffused into the sintered body from its surface whereby the magnet has a coercivity of at least 1,900 kA/m.

In a fifth aspect, the invention provides a rare earth sintered magnet in the form of an anisotropic sintered body comprising $Nd_2Fe_{14}B$ crystal phase as primary phase and having the composition $R^1{}_aT_bM_cAl_fSi_dB_e$ wherein $R^1$ is at least one element selected from rare earth elements inclusive of Sc and Y, T is one or both of Fe and Co, M is at least one element selected from the group consisting of Cu, Zn, In, P, S, Ti, V, Cr, Mn, Ni, Ga, Ge, Zr, Nb, Mo, Pd, Ag, Cd, Sn, Sb, Hf, Ta, and W, Al is aluminum, Si is silicon, B is boron, "a" to "f" indicative of atomic percent in the alloy are in the range: $12 \leq a \leq 17$, $0 \leq c \leq 5$, $0.3 \leq f \leq 10$, $0.3 \leq d \leq 7$, $5 \leq e \leq 10$, and the balance of b, wherein Dy is diffused into the sintered body from its surface whereby the magnet has a coercivity of at least 1,550 kA/m.

Advantageous Effects Of Invention

The rare earth sintered magnet of the invention is based on the anisotropic sintered body containing silicon which allows Dy and/or Tb to diffuse efficiently along grain boundaries in the sintered body. The magnet exhibits a high coercivity and excellent magnetic properties despite a low content of Dy and/or Tb as a whole.

DESCRIPTION OF PREFERRED EMBODIMENTS

Figure 1:
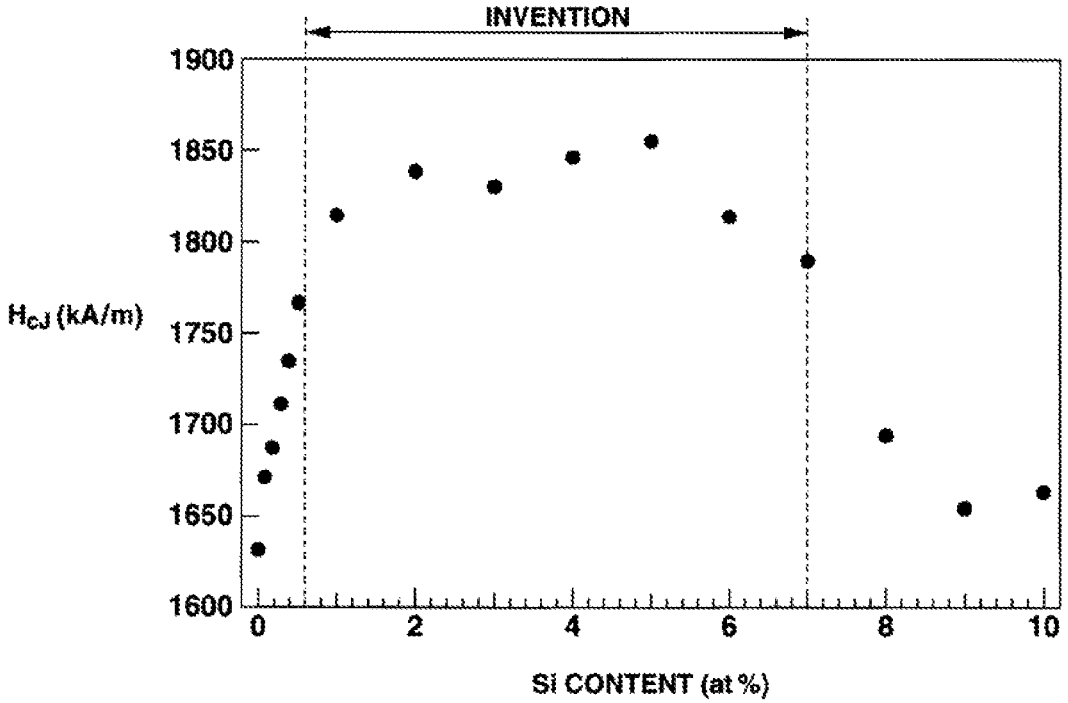
FIG. 1 is a diagram showing coercivity versus Si content of magnet samples in Example 1 and Comparative Example 1.

A first embodiment of the invention is a rare earth sintered magnet in the form of an anisotropic sintered body comprising $Nd_2Fe_{14}B$ crystal phase as primary phase and having the composition $R^1{}_aT_bM_cSi_dB_e$ wherein $R^1$ is at least one element selected from rare earth elements inclusive of Sc and Y, T is one or both of Fe and Co, M is at least one element selected from the group consisting of Al, Cu, Zn, In, P, S, Ti, V, Cr, Mn, Ni, Ga, Ge, Zr, Nb, Mo, Pd, Ag, Cd, Sn, Sb, Hf, Ta, and W, Si is silicon, B is boron, "a" to "e" indicative of atomic percent in the alloy are in the range: $12 \leq a \leq 17$, $0 \leq c \leq 10$, $0.3 \leq d \leq 7$, $5 \leq e \leq 10$, and the balance of b, wherein $R^2$ which is one or both of Dy and Tb is diffused into the anisotropic sintered body from its surface. This magnet is obtained by diffusing $R^2$ or an $R^2$-containing substance into the surface of the anisotropic sintered body.

The anisotropic sintered body or R—Fe—B sintered magnet body may be prepared by the standard method, specifically from a mother alloy by coarse grinding, fine pulverizing, shaping and sintering. The mother alloy contains R, T, M, Si, and B. Herein R is one or more elements selected from rare earth elements inclusive of Sc and Y, specifically from Sc, Y, La, Ce, Pr, Nd, Sm, Eu, Gd, Tb, Dy, Ho, Er, Yb and Lu. Preferably R is mainly composed of Nd, Pr, and/or Dy. These rare earth elements inclusive of Sc and Y preferably account for 12 to 17 at %, more preferably 13 to 15 at % of the entire alloy. More preferably, either one or both of Nd and Pr account for at least 80 at %, even more preferably at least 85 at % of the entire R. T is one or both of Fe and Co; Fe preferably accounts for at least 85 at %, more preferably at least 90 at % of the entire T; and T preferably accounts for 56 to 82 at %, more preferably 67 to 81 at % of the entire alloy. M is one or more elements selected from the group consisting of Al, Cu, Zn, In, P, S, Ti, V, Cr, Mn, Ni, Ga, Ge, Zr, Nb, Mo, Pd, Ag, Cd, Sn, Sb, Hf, Ta, and W, and is present in an amount of 0 to 10 at %, preferably 0.05 to 8 at % of the entire alloy. B indicative of boron is present in an amount of 5 to 10 at %, preferably 5 to 7 at % of the entire alloy.

Herein, the anisotropic sintered body should essentially contain silicon (Si). The inclusion of Si in the anisotropic sintered body or alloy in an amount of 0.3 to 7 at % is effective for significantly promoting supply of Dy/Tb to the magnet and diffusion of Dy/Tb along grain boundaries in the magnet. If the silicon content is less than 0.3 at %, no significant difference in coercivity enhancement is acknowledged. If the silicon content exceeds 7 at %, no significant difference in coercivity enhancement is acknowledged for unknown reasons. The addition of such large amounts of silicon entails a decline of remanence, significantly detracting from the value of magnet for practical use. Although a silicon content of 0.3 to 7 at % is effective for coercivity enhancement, a relatively low content is desirable from the standpoint of enhancing remanence. In this context, the silicon content is preferably 0.5 to 3 at %, more preferably 0.6 to 2 at %, though the exact content varies depending on the finally desired magnetic properties.

It is noted that the balance consists of incidental impurities such as carbon (C), nitrogen (N), and oxygen (O).

While M is as defined above, the alloy preferably contains 0.3 to 10 at %, more preferably 0.5 to 8 at % of aluminum (Al) as M. The inclusion of Al enables to carry out diffusion treatment at an optimum temperature for achieving a higher coercivity enhancement effect, and to carry out aging treatment following the diffusion treatment at an optimum temperature for further enhancing coercivity. Besides Al, the alloy may contain another element as M. Specifically copper (Cu) may be contained in an amount of 0.03 to 8 at %, more preferably 0.05 to 5 at %. The inclusion of Cu also facilitates to carry out diffusion treatment at an optimum temperature for achieving a higher coercivity enhancement effect, and to carry out aging treatment following the diffusion treatment at an optimum temperature for further enhancing coercivity.

The mother alloy is prepared by melting metal or alloy feeds in vacuum or an inert gas atmosphere, preferably argon atmosphere, and casting the melt into a flat mold or book mold or strip casting. Also applicable to the preparation of the mother alloy is a so-called two-alloy process involving separately preparing an alloy approximate to the $R_2Fe_{14}B$ compound composition constituting the primary phase of the relevant alloy and a R—rich alloy serving as liquid phase aid at sintering temperature, crushing, then weighing and mixing them. If there is a tendency of α—Fe being left behind depending on the cooling rate during casting and the alloy composition, the cast alloy approximate to the primary phase composition may be subjected to homogenizing treatment, if desired, for the purpose of increasing the amount of $R_2Fe_{14}B$ compound phase. Specifically, the cast alloy is heat treated at 700 to 1,200° C. for at least one hour in vacuum or in an Ar atmosphere. To the R-rich alloy serving as liquid phase aid, not only the casting technique mentioned above, but also the so-called melt quenching technique or strip casting technique may be applied.

The alloy is first crushed or coarsely ground to a size of typically 0.05 to 3 mm, especially 0.05 to 1.5 mm. The crushing step generally uses a Brown mill or hydrogen decrepitation. For the alloy prepared by strip casting, hydrogen decrepitation is preferred. The coarse powder is then finely divided on a jet mill using high-pressure nitrogen, for example, into a fine particle powder having an average particle size of typically 0.1 to 30 μm, especially 0.2 to 20 μm.

The fine powder is compacted under an external magnetic field by a compression molding machine. The green compact is then placed in a sintering furnace where it is sintered in vacuum or in an inert gas atmosphere typically at a temperature of 900 to 1,250° C., preferably 1,000 to 1,100° C. The resulting sintered magnet block contains 60 to 99% by volume, preferably 80 to 98% by volume of tetragonal $R_2Fe_{14}B$ compound as the primary phase, with the balance consisting of 0.5 to 20% by volume of R—rich phase, 0 to 10% by volume of B—rich phase, and 0.1 to 10% by volume of at least one of R oxide, and carbides, nitrides, hydroxides, and fluorides derived from incidental impurities, and mixtures or composites thereof.

The sintered block is machined to the predetermined shape, if necessary, before it is subjected to grain boundary diffusion step. The dimensions of the block are not particularly limited. A more amount of Dy/Tb is absorbed to the magnet body during grain boundary diffusion step as the magnet body has a larger specific surface area or smaller dimensions. The preferred shape includes a maximum portion with a dimension of up to 100 mm, more preferably up to 50 mm, and a dimension of up to 30 mm, more preferably up to 15 mm in magnetic anisotropy direction. Although the lower limits of the dimension of the maximum portion and the dimension in magnetic anisotropy direction are not critical, the dimension of the maximum portion is preferably at least 1 mm and the dimension in magnetic anisotropy direction is preferably at least 0.5 mm.

In the grain boundary diffusion step, a magnet block with Dy and/or Tb or a Dy and/or Tb-containing substance present on its surface is heat treated for diffusion. Any well-known methods may be employed. The method of disposing Dy and/or Tb or a Dy and/or Tb-containing substance (sometimes referred to as "diffusate") on the magnet body surface is by coating the magnet body surface with the diffusate, or by evaporating the diffusate and contacting the diffusate vapor with the magnet body surface. Specifically, the magnet body surface is coated with a powder of a Dy and/or Tb compound such as oxide, fluoride, oxyfluoride or hydride of Dy and/or Tb, a powder of Dy and/or Tb, a powder of Dy and/or Tb-containing alloy, a sputtered or evaporated film of Dy and/or Tb, or a sputtered or evaporated film of Dy and/or Tb-containing alloy. Alternatively, a mixture of Dy and/or Dy fluoride and a reducing agent such as calcium hydride is applied to the magnet body surface. A further method is by heat treating Dy or Dy alloy in vacuum to form Dy vapor and depositing the Dy vapor onto the magnet body. Any of these methods may be advantageously employed.

While certain elements enrich in the sub-surface layer to enhance magnetocrystalline anisotropy, Dy and Tb make a great contribution to such effect. The content of Dy and/or Tb in the diffusate is preferably at least 30 at %, more preferably at least 50 at %, and most preferably at least 80 at %.

The average coating weight of the diffusate is preferably 10 to 300 $\mu g/mm^2$ more preferably 20 to 200 $\mu g/mm^2$ . With a coating weight of less than 10 $\mu g/mm^2$ no significant coercivity enhancement may be acknowledged. With a coating weight in excess of 300 $\mu g/mm^2$ no further increase of coercivity may be expected. Provided that a magnet body is coated with a diffusate, the average coating weight ($\mu g/mm^2$) is given as (Wr-W)/S wherein W is the weight (μg) of the magnet body prior to diffusate coating, Wr is the weight (μg) of the diffusate-coated magnet body, and S is the surface area ($mm^2$) of the magnet body prior to diffusate coating.

The magnet body having the diffusate disposed on its surface is heat treated for diffusion. Specifically it is heat treated in vacuum or in an inert gas atmosphere such as argon (Ar) or helium (He). This heat treatment is referred to as "diffusion treatment." The diffusion treatment temperature is equal to or lower than the sintering temperature of the magnet body for the following reason. If diffusion treatment is performed at a temperature higher than the sintering temperature (Ts in ° C.) of the magnet body, problems arise that (1) the structure of the sintered magnet is altered so that high magnetic properties may not be available, (2) the dimensions as machined cannot be maintained due to thermal deformation, and (3) diffused $R^2$ is present not only at grain boundaries, but also within grains, inviting a decline of remanence. The diffusion treatment temperature (° C.) is equal to or lower than Ts, preferably equal to or lower than (Ts-10). The diffusion treatment temperature is typically at least 600° C. although the lower limit is not critical.

The diffusion treatment time is typically 1 minute to 100 hours. In less than 1 minute, the diffusion treatment is not completed. If the time exceeds 100 hours, problems may arise that the structure of the sintered magnet is altered, and magnetic properties are adversely affected by inevitable oxidation and evaporation. The diffusion treatment time is preferably 30 minutes to 50 hours, more preferably 1 to 30 hours.

As a result of the diffusion treatment, Dy and/or Tb enriches in the Nd-rich grain boundary phase component within the magnet body whereby Dy and/or Tb substitutes near the surface layer of $R_2Fe_{14}B$ primary phase grains. Now that the magnet body contains 0.3 to 7 at % of silicon, the silicon significantly promotes supply of Dy and/or Tb inward of the magnet body and diffusion of Dy and/or Tb along grain boundaries in the magnet body.

During the diffusion treatment, the total concentration of Nd and Pr in the coating or evaporation source is preferably lower than the total concentration of Nd and Pr (among rare earth elements) in the mother alloy. As a result of the diffusion treatment, the coercivity of R—Fe—B sintered magnet is effectively enhanced without any concomitant decline of remanence, and this coercivity enhancement effect is substantially promoted by the inclusion of a specific content of silicon in the mother alloy.

The coercivity enhancement effect is exerted at a diffusion temperature in the above-defined range. However, the coercivity enhancement effect may become weaker if the diffusion temperature is too low or too high, though within the range. This implies that an optimum range should be selected. For those magnet bodies or anisotropic sintered bodies containing aluminum as M, the optimum diffusion temperature range is 800 to 900° C. when the Al content is up to 0.2 at %; the optimum range becomes wider from 800 to 1,050° C. when the Al content is 0.3 to 10 at %, especially 0.5 to 8 at %. When Tb is diffused typically at a temperature in excess of 900° C., the magnet body has an increased coercivity of at least 1,900 kA/m, preferably at least 1,950 kA/m, and more preferably at least 2,000 kA/m. When Dy is diffused, the magnet body has an increased coercivity of at least 1,550 kA/m, preferably at least 1,600 kA/m, and more preferably at least 1,650 kA/m.

The optimum diffusion temperature for a particular sample is determined by calculating a percent loss from the empirical peak value of coercivity. Provided that Hp is the peak value of coercivity, a consecutive heat treatment temperature range that ensures a coercivity equal to 94% of Hp is regarded as the optimum temperature range.

The optimum diffusion treatment temperature is spread to the relatively high temperature side for the following reason. It is believed that the grain boundary diffusion treatment enhances coercivity through the mechanism that the heavy rare earth element on the magnet body surface is diffused through the grain boundary phase which then turns to liquid phase and further diffused into grains to a depth corresponding to magnetic wall width from the grain interface. If the diffusion temperature is low, both the diffusions are retarded, resulting in a less increase of coercivity. On the other hand, if the diffusion temperature is too high, both the diffusions are excessively promoted, and especially as a result of the latter diffusion becoming outstanding, the heavy rare earth element is deeply and thinly diffused into grains, resulting in a less increase of coercivity. Although the detail is not well understood at the present, Si and Al are effective for suppressing excessive diffusion of heavy rare earth element from grain boundary phase to grain surface. Thus, even when a magnet body is treated at a higher temperature than the optimum diffusion treatment temperature typically set for ordinary magnets, a sufficient increase of coercivity is maintained. Additionally, the diffusion within grain boundary phase is promoted by high temperature treatment, whereby a more increase of coercivity than the ordinary is achievable.

Preferably, the diffusion treatment is followed by heat treatment at a lower temperature, referred to as "aging treatment." The aging treatment is at a temperature lower than the diffusion treatment temperature, preferably a temperature from 200° C. to the diffusion treatment temperature minus 10° C., more preferably a temperature from 350° C. to the diffusion treatment temperature minus 10° C. The atmosphere may be vacuum or an inert gas such as Ar or He. The aging treatment time is typically 1 minute to 10 hours, preferably 10 minutes to 5 hours, and more preferably 30 minutes to 2 hours.

For those magnet bodies or anisotropic sintered bodies containing aluminum as M, the optimum temperature range of aging treatment is 400 to 500° C. when the Al content is up to 0.2 at %; the optimum range becomes wider from 400 to 800° C., especially from 450 to 750° C. when the Al content is 0.3 to 10 at %, especially 0.5 to 8 at %. Aging treatment in the optimum temperature range ensures that the coercivity enhanced by the diffusion treatment is maintained or even further increased.

The optimum aging treatment temperature is spread to the relatively high temperature side for the following reason. It is known that the coercivity of Nd—Fe—B sintered magnet is sensitive to the structure at crystal grain interface. While the sintering step is generally followed by high-temperature heat treatment and low-temperature heat treatment in order to establish an ideal interface structure, the interface structure is largely affected by the latter heat treatment. While heat treatment is done at the predetermined temperature in order to establish an ideal interface structure, the structure changes if the temperature deviates therefrom, resulting in a decline of coercivity. Since Si and Al form a solid solution with the primary phase and grain boundary phase of the magnet, they have an impact on the interface structure. Although the detail is not well understood at the present, these elements function to maintain the optimum structure even when heat treatment is done in a higher temperature range than the optimum heat treatment temperature.

With respect to the machining prior to diffusion treatment, if machining is carried out by a machining tool with an aqueous coolant, or if the machined surface is exposed to high temperatures during machining, there is a propensity that an oxide film forms on the machined surface. This oxide film may prevent absorption reaction of Dy/Tb to the magnet body. In such cases, the oxide film may be removed by cleaning with an alkali, acid, organic solvent or a combination thereof, or by shot blasting. The resulting magnet body is ready for appropriate absorption treatment. Suitable alkalis include potassium pyrophosphate, sodium pyrophosphate, potassium citrate, sodium citrate, potassium acetate, sodium acetate, potassium oxalate, and sodium oxalate. Suitable acids include hydrochloric acid, nitric acid, sulfuric acid, acetic acid, citric acid, and tartaric acid. Suitable organic solvents include acetone, methanol, ethanol, and isopropyl alcohol. The alkali and acid may be used as an aqueous solution having a sufficient concentration not to attack the magnet body.

After the magnet body is subjected to diffusion treatment and subsequent aging treatment, it is cleaned with an alkali, acid, organic solvent or a combination thereof, or machined to the practical shape. Furthermore, after the diffusion treatment, aging treatment, and optional cleaning and/or machining, the magnet body may be plated or coated with paint.

The thus obtained magnet is useful as a permanent magnet having an enhanced coercivity.

EXAMPLE

Examples are given below for further illustrating the invention although the invention is not limited thereto.

In Examples, the "average particle size" is determined as a weight average diameter $D_{50}$ (i.e., a particle diameter at 50% by weight cumulative, or median diameter) on particle size distribution measurement by the laser diffractometry.

Example 1 and Comparative Example 1

A ribbon form alloy consisting essentially of 14.5 at % Nd, 0.5 at % Al, 0.2 at % Cu, 6.2 at % B, 0 to 10 at % Si, and the balance of Fe was prepared by the strip casting technique, specifically by using Nd, Al, Fe and Cu metals having a purity of at least 99 wt %, Si having a purity of 99.99 wt %, and ferroboron, high-frequency heating in an Ar atmosphere for melting, and casting the melt onto a single chill roll of copper. The alloy was exposed to 0.11 MPa of hydrogen at room temperature so that hydrogen was absorbed therein, heated up to 500° C. while vacuum pumping so that hydrogen was partially desorbed, cooled, and sieved, collecting a coarse powder under 50 mesh.

The coarse powder was finely pulverized on a jet mill using high pressure nitrogen gas, into a fine powder having a median diameter of 5 μm. The fine powder was compacted under a pressure of about 1 ton/cm$^2$ in a nitrogen atmosphere while being oriented in a magnetic field of 15 kOe. The green compact was then placed in a sintering furnace where it was sintered in argon atmosphere at 1,060° C. for 2 hours, obtaining a sintered magnet block. Using a diamond cutter, the sintered block was ground on entire surfaces into a block of 15 mm×15 mm×3 mm thick. It was successively cleaned with alkaline solution, deionized water, nitric acid, and deionized water, and dried, yielding a magnet block.

Next, the magnet block was immersed for 30 seconds in a slurry of terbium oxide powder in ethanol at a weight fraction of 50%. The terbium oxide powder had an average particle size of 0.15 μm. The magnet block was taken out, allowed to drain and dried under hot air blow. The average coating weight of powder was 50±5 μg/mm$^2$. The immersion and drying steps were repeated, if necessary, until the desired coating weight was reached.

The magnet block covered with terbium oxide was subjected to diffusion treatment in Ar atmosphere at 900° C. for 5 hours and then to aging treatment at 500° C. for 1 hour, and quenched, yielding a diffusion treated magnet block. FIG. 1 is a diagram where the coercivity after grain boundary diffusion is plotted as a function of silicon content (at %). It is noted that a magnet block free of silicon prior to grain boundary diffusion had a coercivity of 995 kA/m. It is seen from FIG. 1 that coercivity improvement is attained by addition of at least 0.3 at % of Si and becomes significant is when the content of Si added is equal to or more than 0.5 at %. On the other hand, the coercivity decreases when the content of Si added exceeds 7 at %. It is demonstrated that a high coercivity is developed when 0.3 to 7 at % of silicon is added to the mother alloy.

Example 2 and Comparative Example 2

Figure 2:
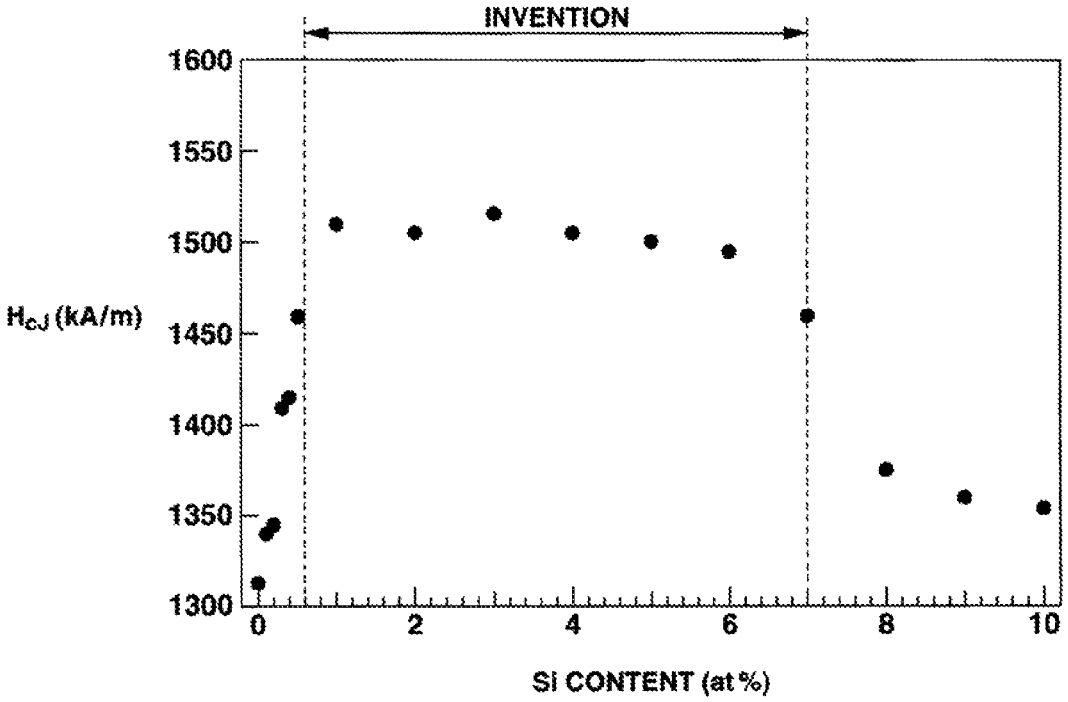
FIG. 2 is a diagram showing coercivity versus Si content of magnet samples in Example 2 and Comparative Example 2.

A magnet block was prepared as in Example 1 except that dysprosium oxide (average particle size 0.35 μm, average coating weight 50±5 μm/mm$^2$) was used instead of terbium oxide. FIG. 2 is a diagram where the coercivity after grain boundary diffusion is plotted as a function of silicon content (at %). Since the anisotropic magnetic field of $Dy_2Fe_{14}B$ is weaker than that of $Tb_2Fe_{14}B$, all the coercivity values are low as compared with FIG. 1. Nevertheless, a coercivity improvement over the silicon-free magnet is recognized when 0.3 to 7 at % of silicon is added.

It is demonstrated that the addition of 0.3 to 7 at % of silicon to the mother alloy enables the magnet to develop a high coercivity not only when Tb is diffused, but also when Dy is diffused.

Examples 3, 4 and Comparative Examples 3, 4

Figure 3:
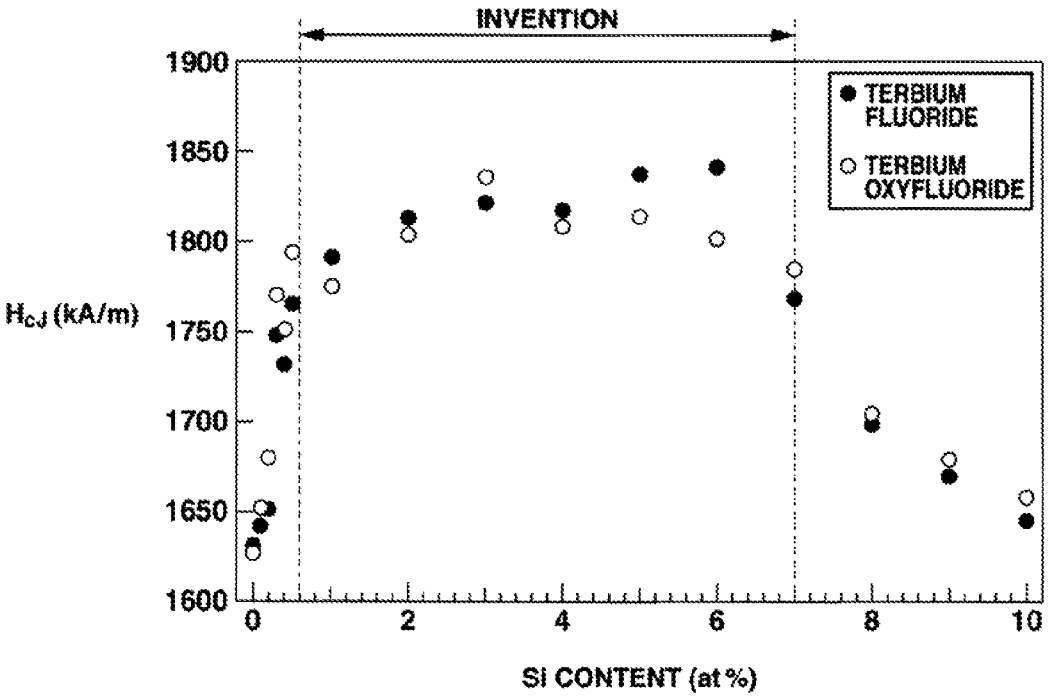
FIG. 3 is a diagram showing coercivity versus Si content of magnet samples in Examples 3, 4 and Comparative Examples 3, 4.

A magnet block was prepared as in Example 1 except that terbium fluoride (average particle size 1.4 μm, average coating weight 50±5 μg/mm$^2$) or terbium oxyfluoride (average particle size 2.1 μm, average coating weight 50±5 μg/mm$^2$) was used instead of terbium oxide. FIG. 3 is a diagram where the coercivity after grain boundary diffusion is plotted as a function of silicon content (at %). It is demonstrated that a high coercivity is developed not only when oxide is used as the Tb diffusion source, but also when fluoride or oxyfluoride is used.

Examples 5, 6 and Comparative Examples 5, 6

Figure 4:
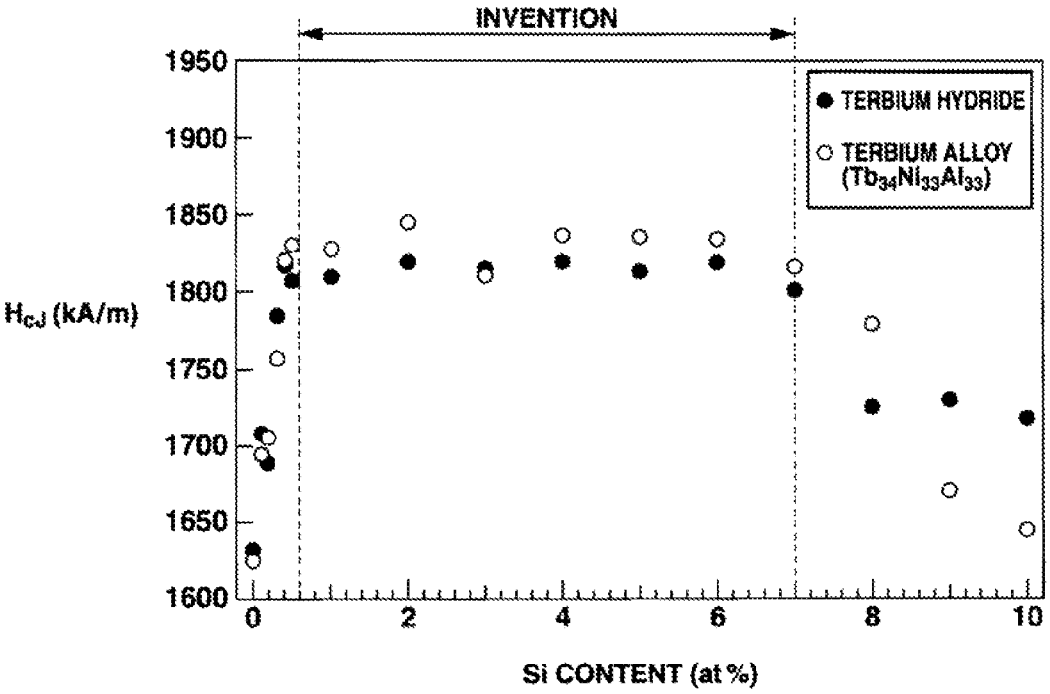
FIG. 4 is a diagram showing coercivity versus Si content of magnet samples in Examples 5, 6 and Comparative Examples 5, 6.

A magnet block was prepared as in Example 1 except that terbium hydride (average particle size 6.7 μm, average coating weight 35±5 μg/mm$^2$) or $Tb_{34}Ni_{33}Al_{33}$ alloy (in at %, average particle size 10 μm, average coating weight 45±5μg/mm$^2$) was used instead of terbium oxide. FIG. 4 is a diagram where the coercivity after grain boundary diffusion is plotted as a function of silicon content (at %). It is demonstrated that a high coercivity is developed not only when a non-metallic compound such as oxide is used as the Tb diffusion source, but also when a powder of hydride, metal or alloy is used.

Example 7 and Comparative Example 7

Figure 5:
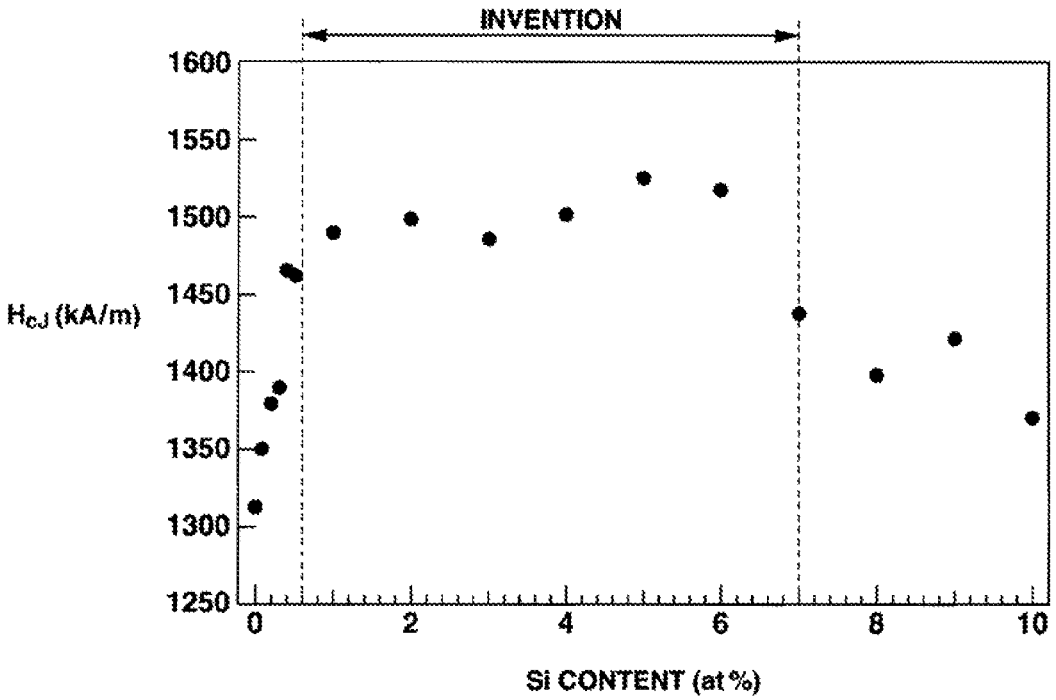
FIG. 5 is a diagram showing coercivity versus Si content of magnet samples in Example 7 and Comparative Example 7.

A sintered magnet block was obtained as in Example 1. Using a diamond cutter, the sintered block was ground on entire surfaces into a block of 15 mm×15 mm×3 mm thick. It was successively cleaned with alkaline solution, deionized water, nitric acid, and deionized water, and dried, yielding a magnet block. Dy metal was placed in an alumina boat (inner diameter 40 mm, height 25 mm), which was placed in a molybdenum container (internal dimensions 50 mm×100 mm×40 mm) along with the magnet block. The container was put in a controlled atmosphere furnace where diffusion treatment was performed at 900° C. for 5 hours in a vacuum atmosphere which was established by a rotary pump and diffusion pump. This was followed by aging treatment at 500° C. for one hour and quenching, yielding a magnet block. FIG. 5 is a diagram where the coercivity after grain boundary diffusion is plotted as a function of silicon content (at %). It is demonstrated that a high coercivity is developed by diffusion treatment starting with not only Dy coating, but also deposition of Dy vapor.

Example 8 and Comparative Example 8

Figure 6:
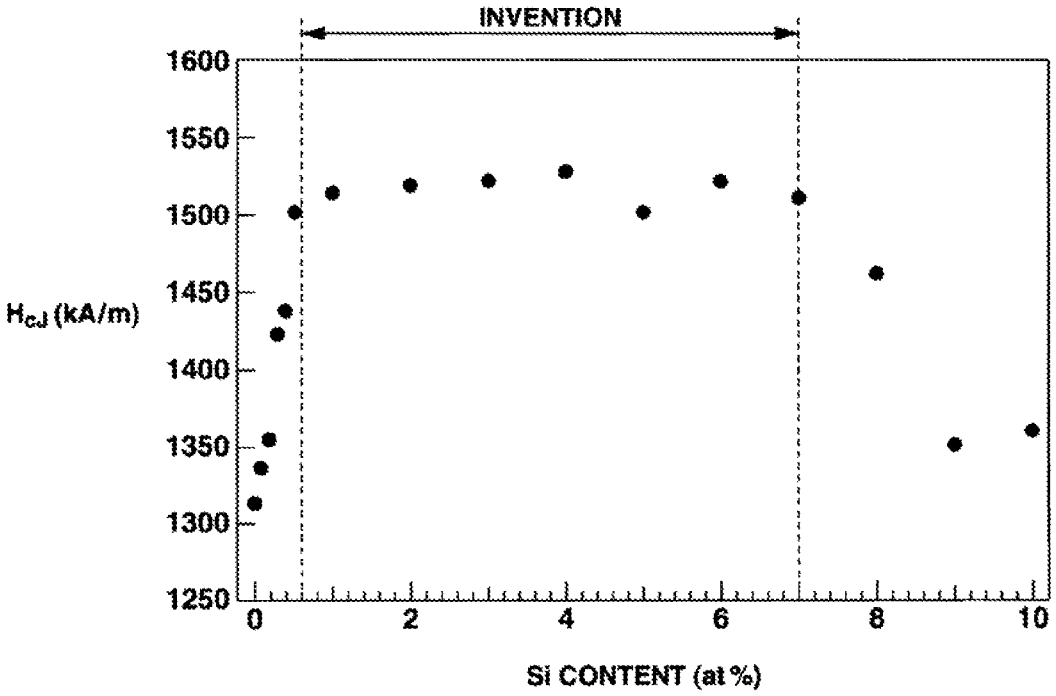
FIG. 6 is a diagram showing coercivity versus Si content of magnet samples in Example 8 and Comparative Example 8.

A magnet block was prepared as in Example 7 except that $Dy_{34}Fe_{66}$ (at %) was used instead of Dy metal. FIG. 6 is a diagram where the coercivity after grain boundary diffusion is plotted as a function of silicon content (at %). It is demonstrated that a high coercivity is developed when not only Dy metal, but also Dy alloy is used as the Dy evaporation source.

Example 9 and Comparative Example 9

A ribbon form alloy consisting of 12.5 at % Nd, 2 at % Pr, 0.5 at % Al, 0.4 at % Cu, 5.5 at % B, 1.3 at % Si, and the balance of Fe was prepared by the strip casting technique, specifically by using Nd, Pr, Al, Fe and Cu metals having a purity of at least 99 wt %, Si having a purity of 99.99 wt %, and ferroboron, high-frequency heating in an Ar atmosphere for melting, and casting the melt onto a single chill roll of copper. The alloy was exposed to 0.11 MPa of hydrogen at room temperature so that hydrogen was absorbed therein, heated up to 500° C. while vacuum pumping so that hydrogen was partially desorbed, cooled, and sieved, collecting a coarse powder under 50 mesh.

The coarse powder was finely pulverized on a jet mill using high pressure nitrogen gas, into a fine powder having a median diameter of 3.8 μm. The fine powder was compacted under a pressure of about 1 ton/cm$^2$ in a nitrogen atmosphere while being oriented in a magnetic field of 15 kOe. The green compact was then placed in a sintering furnace where it was sintered in argon atmosphere at 1,060° C. for 2 hours, obtaining a sintered magnet block. Using a diamond cutter, the sintered block was ground on entire surfaces into a block of 20 mm×50 mm×4 mm thick. It was successively cleaned with alkaline solution, deionized water, nitric acid, and deionized water, and dried, yielding a magnet block.

Next, the magnet block was immersed for 30 seconds in a slurry of terbium oxide powder in ethanol at a weight fraction of 50%. The terbium oxide powder had an average particle size of 0.15 μm. The magnet block was taken out, allowed to drain, and dried under hot air blow. The average coating weight of powder was 50±5 μg/mm$^2$. The immersion and drying steps were repeated, if necessary, until the desired coating weight was reached.

The magnet block covered with terbium oxide was subjected to diffusion treatment in Ar atmosphere at 850° C. for 20 hours and then to aging treatment at 500° C. for 1 hour, and quenched, yielding a diffusion treated magnet block P9.

For comparison, an alloy consisting of 12.5 at % Nd, 2 at % Pr, 0.5 at % Al, 0.4 at % Cu, 6.1 at % B, and the balance of Fe (i.e., silicon-free alloy) was prepared by the same technique as above. By following the same procedure as above, a comparative magnet block C9 was obtained.

Table 1 tabulates the coercivity of magnet blocks P9 and C9. It is evident that magnet block P9 having silicon added thereto within the scope of the invention has a higher coercivity.

TABLE 1

| | | Hcj (kA/m) |
|---|---|---|
| Example 9 | P9 | 2,069 |
| Comparative Example 9 | C9 | 1,800 |

Example 10 and Comparative Example 10

A ribbon form alloy consisting of 13.0 at % Nd, 1.5 at % Dy, 1.5 at % Co, 1.0 at % Si, 0.5 at % Al, 5.8 at % B, and the balance of Fe was prepared by the strip casting technique, specifically by using Nd, Dy, Co, Al and Fe metals having a purity of at least 99 wt %, Si having a purity of 99.99 wt %, and ferroboron, high-frequency heating in an Ar atmosphere for melting, and casting the melt onto a single chill roll of copper. The alloy was exposed to 0.11 MPa of hydrogen at room temperature so that hydrogen was absorbed therein, heated up to 500° C. while vacuum pumping so that hydrogen was partially desorbed, cooled, and sieved, collecting a coarse powder under 50 mesh.

The coarse powder was finely pulverized on a jet mill using high pressure nitrogen gas, into a fine powder having a median diameter of 4.6 μm. The fine powder was compacted under a pressure of about 1 ton/cm$^2$ in a nitrogen atmosphere while being oriented in a magnetic field of 15 kOe. The green compact was then placed in a sintering furnace where it was sintered in argon atmosphere at 1,060° C. for 2 hours, obtaining a sintered magnet block. Using a diamond cutter, the sintered block was ground on entire surfaces into a block of 7 mm×7 mm×2 mm thick. It was successively cleaned with alkaline solution, deionized water, nitric acid, and deionized water, and dried, yielding a magnet block.

Next, the magnet block was immersed for 30 seconds in a slurry of terbium oxide powder in deionized water at a weight fraction of 50%. The terbium oxide powder had an average particle size of 0.15 μm. The magnet block was taken out, allowed to drain, and dried under hot air blow. The average coating weight of powder was 50±5 μg/mm$^2$. The immersion and drying steps were repeated, if necessary, until the desired coating weight was reached.

The magnet block covered with terbium oxide was subjected to diffusion treatment in Ar atmosphere at 850° C. for 10 hours and then to aging treatment at 520° C. for 1 hour, and quenched, yielding a diffusion treated magnet block P10.

For comparison, an alloy consisting of 13.0 at % Nd, 1.5 at % Dy, 1.5 at % Co, 0.5 at % Al, 5.8 at % B, and the balance of Fe (i.e., silicon-free alloy) was prepared by the same technique as above. By following the same procedure as above, a comparative magnet block C10 was obtained.

Table 2 tabulates the coercivity of magnet blocks P10 and C10. A coercivity enhancement effect is also acknowledged when Dy is previously contained in the mother alloy.

TABLE 2

| | | Hcj (kA/m) |
|---|---|---|
| Example 10 | P10 | 2,466 |
| Comparative Example 10 | C10 | 2,172 |

Example 11 and Comparative Example 11

A ribbon form alloy consisting of 12.0 at % Nd, 2.0 at % Pr, 0.5 at % Ce, x at % Si (wherein x=0 or 1.5), 1.0 at % Al, 0.5 at % Cu, y at % M (wherein y=0.05 to 2 (see Table 3), M is Ti, V, Cr, Mn, Ni, Ga, Ge, Zr, Nb, Mo, Ag, Sn, Sb, Hf, Ta or W), 6.2 at % B, and the balance of Fe was prepared by the strip casting technique, specifically by using Nd, Pr, Ce, Al, Fe, Cu, Ti, V, Cr, Mn, Ni, Ga, Ge, Zr, Nb, Mo, Ag, Sn, Sb, Hf, Ta and W metals having a purity of at least 99 wt %, Si having a purity of 99.99 wt %, and ferroboron, high-frequency heating in an Ar atmosphere for melting, and casting the melt onto a single chill roll of copper. The alloy was exposed to 0.11 MPa of hydrogen at room temperature so that hydrogen was absorbed therein, heated up to 500° C. while vacuum pumping so that hydrogen was partially desorbed, cooled, and sieved, collecting a coarse powder under 50 mesh.

The coarse powder was finely pulverized on a jet mill using high pressure nitrogen gas, into a fine powder having a median diameter of 5.2 μm. The fine powder was compacted under a pressure of about 1 ton/cm$^2$ in a nitrogen atmosphere while being oriented in a magnetic field of 15 kOe. The green compact was then placed in a sintering furnace where it was sintered in argon atmosphere at 1,040° C. for 2 hours, obtaining a sintered magnet block. Using a diamond cutter, the sintered block was ground on entire surfaces into a block of 7 mm×7 mm×2.5 mm thick. It was successively cleaned with alkaline solution, deionized water, citric acid, and deionized water, and dried, yielding a magnet block.

Next, the magnet block was immersed for 30 seconds in a slurry of a 50:50 (weight ratio) terbium fluoride/terbium oxide powder mixture in ethanol at a weight fraction of 50%. The terbium fluoride powder and terbium oxide powder had an average particle size of 1.4 μm, and 0.15 μm, respectively. The magnet block was taken out, allowed to drain, and dried under hot air blow. The average coating weight of powder was 30±5 μg/mm$^2$. The immersion and drying steps were repeated, if necessary, until the desired coating weight was reached.

The magnet block covered with terbium fluoride/terbium oxide was subjected to absorption treatment in Ar atmosphere at 850° C. for 15 hours and then to aging treatment at 500° C. for 1 hour, and quenched, yielding a diffusion treated magnet block. Of these magnet blocks, those blocks having silicon added thereto (x=1.5) are designated inventive magnet blocks P11-1 to P11-16 in the order of the additive element M=Ti, V, Cr, Mn, Ni, Ga, Ge, Zr, Nb, Mo, Ag, Sn, Sb, Hf, Ta, and W. Those blocks free of silicon (x=0) for comparison are similarly designated comparative magnet blocks C11-1 to C11-16.

Table 3 tabulates the magnetic properties of magnet blocks P11-1 to P11-16 and C11-1 to C11-16. A comparison of the magnet blocks of identical M whether or not silicon is added reveals that inventive magnet blocks P11-1 to P11-16 exhibit higher values of coercivity.

TABLE 3

| | | Si content, x | M | M content, y | Hcj (kA/m) |
|---|---|---|---|---|---|
| Example 11 | P11-1 | 1.5 | Ti | 0.1 | 1,873 |
| | P11-2 | 1.5 | V | 0.15 | 1,916 |
| | P11-3 | 1.5 | Cr | 0.8 | 1,860 |
| | P11-4 | 1.5 | Mn | 0.8 | 1,851 |
| | P11-5 | 1.5 | Ni | 0.7 | 1,795 |
| | P11-6 | 1.5 | Ga | 0.1 | 1,947 |
| | P11-7 | 1.5 | Ge | 0.7 | 1,886 |
| | P11-8 | 1.5 | Zr | 0.2 | 1,883 |
| | P11-9 | 1.5 | Nb | 0.15 | 1,869 |
| | P11-10 | 1.5 | Mo | 0.2 | 1,881 |
| | P11-11 | 1.5 | Ag | 0.3 | 1,792 |
| | P11-12 | 1.5 | Sn | 0.5 | 1,834 |
| | P11-13 | 1.5 | Sb | 0.5 | 1,826 |
| | P11-14 | 1.5 | Hf | 0.15 | 1,889 |
| | P11-15 | 1.5 | Ta | 0.1 | 1,907 |
| | P11-16 | 1.5 | W | 0.1 | 1,866 |
| Comparative Example 11 | C11-1 | 0 | Ti | 0.1 | 1,705 |
| | C11-2 | 0 | V | 0.15 | 1,695 |
| | C11-3 | 0 | Cr | 0.8 | 1,711 |
| | C11-4 | 0 | Mn | 0.8 | 1,669 |
| | C11-5 | 0 | Ni | 0.7 | 1,678 |
| | C11-6 | 0 | Ga | 0.1 | 1,721 |
| | C11-7 | 0 | Ge | 0.7 | 1,791 |
| | C11-8 | 0 | Zr | 0.2 | 1,703 |
| | C11-9 | 0 | Nb | 0.15 | 1,688 |
| | C11-10 | 0 | Mo | 0.2 | 1,696 |
| | C11-11 | 0 | Ag | 0.3 | 1,674 |
| | C11-12 | 0 | Sn | 0.5 | 1,690 |
| | C11-13 | 0 | Sb | 0.5 | 1,710 |
| | C11-14 | 0 | Hf | 0.15 | 1,726 |
| | C11-15 | 0 | Ta | 0.1 | 1,735 |
| | C11-16 | 0 | W | 0.1 | 1,719 |

It is thus concluded that the addition of 0.3 to 7 at % of silicon to the mother alloy helps promote the coercivity enhancement effect of grain boundary diffusion treatment so that higher magnetic properties may be developed. The invention provides R—Fe—B sintered magnets capable of high performance despite minimal usage of Tb or Dy.

Example 12

Three ribbon form alloys consisting of 14.5 at % Nd, 0.2 at % Cu, 6.2 at % B, 1.2 at % Al and 1.2 at % Si, 2 at % Al and 3 at % Si, or 5 at % Al and 3 at % Si, and the balance of Fe were prepared by the strip casting technique, specifically by using Nd, Al, Fe and Cu metals having a purity of at least 99 wt %, Si having a purity of 99.99 wt %, and ferroboron, high-frequency heating in an Ar atmosphere for melting, and casting the melt onto a single chill roll of copper. The alloys were exposed to 0.11 MPa of hydrogen at room temperature so that hydrogen was absorbed therein, heated up to 500° C. while vacuum pumping so that hydrogen was partially desorbed, cooled, and sieved, collecting a coarse powder under 50 mesh.

Each coarse powder was finely pulverized on a jet mill using high pressure nitrogen gas, into a fine powder having a median diameter of 5 μm. The fine powder was compacted under a pressure of about 1 ton/cm$^2$ in a nitrogen atmosphere while being oriented in a magnetic field of 15 kOe. The green compact was then placed in a sintering furnace where it was sintered in argon atmosphere at 1,060° C. for 2 hours, obtaining a sintered magnet block. Using a diamond cutter, the sintered block was ground on entire surfaces into a block of 15 mm×15 mm×3 mm thick. It was successively cleaned with alkaline solution, deionized water, nitric acid, and deionized water, and dried, yielding a magnet block.

Next, each magnet block was immersed for 30 seconds in a slurry of terbium oxide powder in ethanol at a weight fraction of 50%. The terbium oxide powder had an average particle size of 0.15 μm. The magnet block was taken out, allowed to drain, and dried under hot air blow. The average coating weight of powder was 50±5 μg/mm$^2$. The immersion and drying steps were repeated, if necessary, until the desired coating weight was reached.

Each magnet block covered with terbium oxide was subjected to diffusion treatment in Ar atmosphere at 950° C. for 5 hours and then to aging treatment for 1 hour at 510° C. in case of the magnet block with 1.2 at % Al and 1.2 at % Si, 550° C. in case of the magnet block with 3 at % Al and 2 at % Si, or 610° C. in case of the magnet block with 5 at % Al and 3 at % Si, and quenched, yielding a diffusion treated magnet block.

The coercivity of the resulting magnet blocks was measured, with the results shown below.

| Magnet with Al and Si contents | Coercivity |
|---|---|
| 1.2 at % Al and 1.2 at % Si | 1,972 kA/m |
| 3 at % Al and 2 at % Si | 2,038 kA/m |
| 5 at % Al and 3 at % Si | 2,138 kA/m |

Example 13

Magnet blocks were prepared as in Example 12 except that dysprosium oxide (average particle size 0.35 μm, average coating weight 50±5 μg/mm$^2$) was used instead of terbium oxide.

The coercivity of the resulting magnet blocks was measured, with the results shown below.

| Magnet with Al and Si contents | Coercivity |
|---|---|
| 1.2 at % Al and 1.2 at % Si | 1,701 kA/m |
| 3 at % Al and 2 at % Si | 1,758 kA/m |
| 5 at % Al and 3 at % Si | 1,863 kA/m |

Example 14 and Comparative Example 12

A ribbon form alloy consisting of 14.5 at % Nd, 0.2 at % Cu, 6.2 at % B, 1.0 at % Al, 1.0 at % Si, and the balance of Fe was prepared by the strip casting technique, specifically by using Nd, Al, Fe and Cu metals having a purity of at least 99 wt %, Si having a purity of 99.99 wt %, and ferroboron, high-frequency heating in an Ar atmosphere for melting, and casting the melt onto a single chill roll of copper. The alloy was exposed to 0.11 MPa of hydrogen at room temperature so that hydrogen was absorbed therein, heated up to 500° C. while vacuum pumping so that hydrogen was partially desorbed, cooled, and sieved, collecting a coarse powder under 50 mesh.

The coarse powder was finely pulverized on a jet mill using high pressure nitrogen gas, into a fine powder having a median diameter of 5 μm. The fine powder was compacted under a pressure of about 1 ton/cm$^2$ in a nitrogen atmosphere while being oriented in a magnetic field of 15 kOe. The green compact was then placed in a sintering furnace where it was sintered in argon atmosphere at 1,060° C. for 2 hours, obtaining a sintered magnet block. Using a diamond cutter, the sintered block was ground on entire surfaces into a block of 15 mm×15 mm×3 mm thick. It was successively cleaned with alkaline solution, deionized water, nitric acid, and deionized water, and dried, yielding a magnet block.

Next, the magnet block was immersed for 30 seconds in a slurry of terbium oxide powder in ethanol at a weight fraction of 50%. The terbium oxide powder had an average particle size of 0.15 μm. The magnet block was taken out, allowed to drain and dried under hot air blow. The average coating weight of powder was 50±5 μg/mm$^2$. The immersion and drying steps were repeated, if necessary, until the desired coating weight was reached.

The magnet block covered with terbium oxide was heat treated in Ar atmosphere at 850° C., 900° C., 950° C. or 1,000° C. for 5 hours and then cooled to room temperature, yielding a diffusion treated magnet block. These magnet blocks are designated inventive magnet blocks 14-1-1 to 14-1-4.

Magnet blocks 14-2-1 to 14-2-4 were prepared under the same conditions as above except that the alloy composition of Example 14 was changed to 3.0 at % Al and 2.0 at % Si. Also, magnet blocks 14-3-1 to 14-3-4 were prepared under the same conditions as above except that the alloy composition of Example 14 was changed to 5.0 at % Al and 3.0 at % Si. For comparison, magnet blocks 12-1 to 12-4 were prepared under the same conditions as above except that the alloy composition of Example 14 was changed to 0.2 at % Al and 0.2 at % Si.

The magnet blocks 14-1-1 to 14-3-4 and comparative magnet blocks 12-1 to 12-4 were subjected to aging treatment at a temperature varying from 400° C. to 800° C. at an interval of 20-30° C. for 1 hour. The magnet blocks were measured for coercivity. Of magnet blocks 14-1-1, the block having the maximum coercivity is designated 14-1-19-1. Similarly, of magnet blocks 14-1-2, the block having the maximum coercivity is designated 14-1-2-1; of magnet blocks 14-1-3, the block having the maximum coercivity is designated 14-1-3-1; of magnet blocks 14-1-4, the block having the maximum coercivity is designated 14-1-4-1.

Similarly, of magnet blocks 14-2-1 to 14-3-4, the blocks having the maximum coercivity are designated 14-2-1-1 to 14-3-4-1, respectively. Of comparative magnet blocks 12-1, the block having the maximum coercivity is designated 12-1-1; of comparative magnet blocks 12-2, the block having the maximum coercivity is designated 12-2-1; of comparative magnet blocks 12-3, the block having the maximum coercivity is designated 12-3-1; of comparative magnet blocks 12-4, the block having the maximum coercivity is designated 12-4-1.

Figure 7:
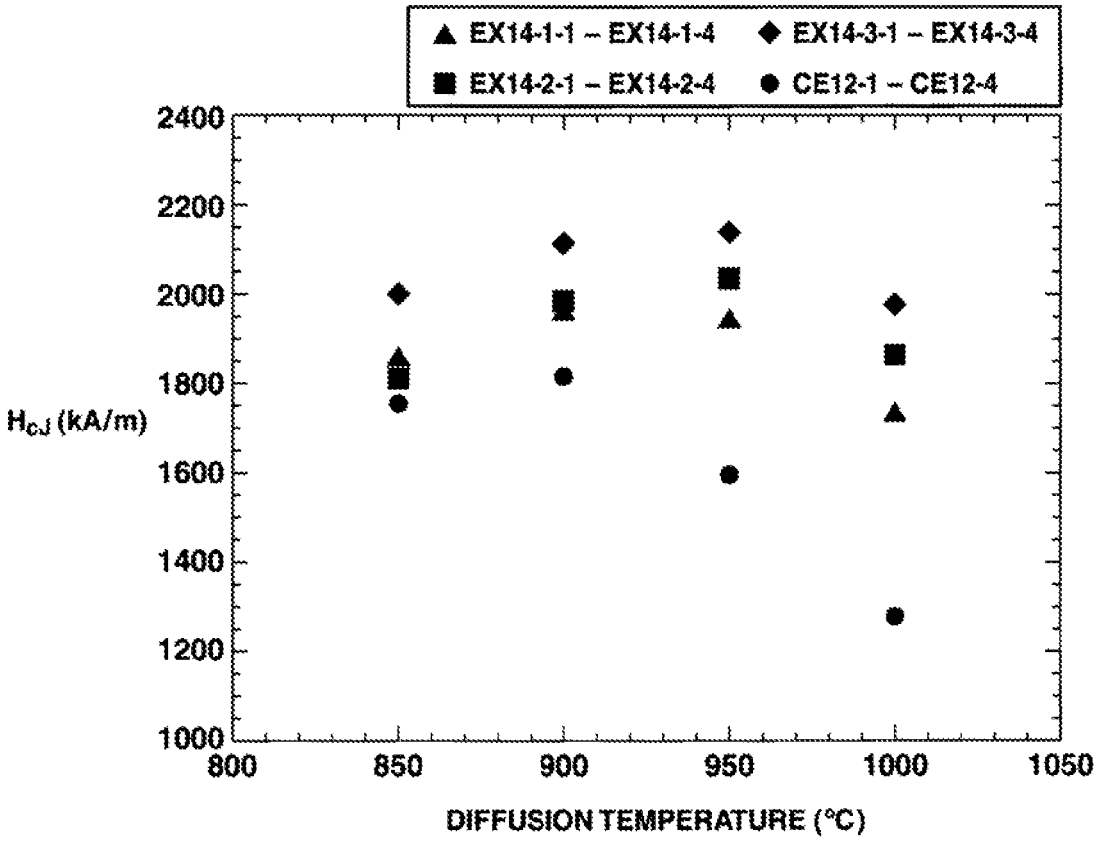
FIG. 7 is a diagram showing coercivity versus diffusion temperature of magnet samples having different Al and Si contents in Example 14 and Comparative Example 12.

FIG. 7 is a diagram where the coercivity of blocks 14-1-1-1 to 14-1-4-1 and comparative blocks 12-1-1 to 12-4-1 is plotted as a function of grain boundary diffusion temperature. As seen from FIG. 7, the inventive blocks exhibit higher values of coercivity than the comparative blocks with Al and Si contents of less than 0.3 at %, and their grain boundary diffusion temperature is spread to the high temperature side.

Table 4 tabulates the optimum grain boundary diffusion treatment temperature span which is determined from FIG. 7 for inventive blocks 14-1 (Al=1.0, Si=1.0), inventive blocks 14-2 (Al=3.0, Si=2.0), inventive blocks 14-3 (Al=5.0, Si=3.0), and comparative blocks 12 (Al=0.2, Si=0.2).

TABLE 4

| Sample | Al (at %) | Si (at %) | Lower limit of optimum diffusion temperature (° C.) | Upper limit of optimum diffusion temperature (° C.) | Optimum diffusion temperature span (° C.) | Maximum coercivity (kA/m) |
|---|---|---|---|---|---|---|
| Example 14-1 | 1.0 | 1.0 | 850 | 950 | 100 | 1,966 |
| Example 14-2 | 3.0 | 2.0 | 850 | 950 | 100 | 2,038 |

TABLE 4-continued

| Sample | Al (at %) | Si (at %) | Lower limit of optimum diffusion temperature (° C.) | Upper limit of optimum diffusion temperature (° C.) | Optimum diffusion temperature span (° C.) | Maximum coercivity (kA/m) |
|---|---|---|---|---|---|---|
| Example 14-3 | 5.0 | 3.0 | 850 | 1,000 | 150 | 2,138 |
| Comparative Example 12 | 0.2 | 0.2 | 850 | 900 | 50 | 1,817 |

After the magnet blocks 14-1 to 14-3 were subjected grain boundary diffusion treatment at the optimum temperature (corresponding to the maximum coercivity) for 5 hours, they were subjected to aging treatment at a temperature varying from 400° C. to 800° C. at an interval of 20-30° C. for 1 hour. The magnet blocks were measured for coercivity, from which the optimum aging treatment temperature span was determined. The results are shown in Table 5.

TABLE 5

| Sample | Al (at %) | Si (at %) | Lower limit of optimum aging temperature (° C.) | Upper limit of optimum aging temperature (° C.) | Optimum aging temperature span (° C.) | Maximum coercivity (kA/m) |
|---|---|---|---|---|---|---|
| Example 14-1 | 1.0 | 1.0 | 410 | 550 | 140 | 1,966 |
| Example 14-2 | 3.0 | 2.0 | 410 | 590 | 180 | 2,038 |
| Example 14-3 | 5.0 | 3.0 | 470 | 670 | 200 | 2,138 |
| Comparative Example 12 | 0.2 | 0.2 | 430 | 510 | 80 | 1,817 |

As seen from Table 5, Comparative Example 12 has an optimum aging treatment temperature span of 80° C. Example 14 has an optimum aging treatment temperature span of 140° C. or more, indicating that the allowable span of aging treatment temperature is spread.

Example 15 and Comparative Example 13

Like magnet blocks 14-1-1 to 14-1-4, magnet blocks were prepared via heat treatment steps as in Example 14 and Comparative Example 12 except that dysprosium oxide (average particle size 0.35 μm) was used instead of terbium oxide. They are designated blocks 15-1-1 to 15-1-4.

Magnet blocks 15-2-1 to 15-2-4 were prepared under the same conditions as above (blocks 15-1-1 to 15-1-4) except that the alloy composition was changed to 3.0 at % Al and 2.0 at % Si. Also, magnet blocks 15-3-1 to 15-3-4 were similarly prepared except that the alloy composition was changed to 5.0 at % Al and 3.0 at % Si. For comparison, magnet blocks 13-1 to 13-4 were similarly prepared except that the alloy composition was changed to 0.2 at % Al and 0.2 at % Si.

The magnet blocks 15-1-1 to 15-3-4 and comparative magnet blocks 13-1 to 13-4 were subjected to aging treatment at a temperature varying from 400° C. to 800° C. at an interval of 20-30° C. for 1 hour. The magnet blocks were measured for coercivity. Of magnet blocks 15-1-1, the block having the maximum coercivity is designated 15-1-1-1. Similarly, of magnet blocks 15-1-2, the block having the maximum coercivity is designated 15-1-2-1; of magnet blocks 15-1-3, the block having the maximum coercivity is designated 15-1-3-1; of magnet blocks 15-1-4, the block having the maximum coercivity is designated 15-1-4-1. Similarly, of magnet blocks 15-2-1 to 15-3-4, the blocks having the maximum coercivity are designated 15-2-1-1 to 15-3-4-1, respectively. Of comparative magnet blocks 13-1, the block having the maximum coercivity is designated 13-1-1; of comparative magnet blocks 13-2, the block having the maximum coercivity is designated 13-2-1; of comparative magnet blocks 13-3, the block having the maximum coercivity is designated 13-3-1; of comparative magnet blocks 13-4, the block having the maximum coercivity is designated 13-4-1.

Table 6 tabulates the lower limit, upper limit and span of optimum grain boundary diffusion treatment temperature, the lower limit, upper limit and span of optimum aging treatment temperature, as well as the maximum coercivity.

TABLE 6

| Sample | Al (at %) | Si (at %) | Lower limit of optimum diffusion temperature (° C.) | Upper limit of optimum diffusion temperature (° C.) | Optimum diffusion temperature span (° C.) | Lower limit of optimum aging temperature (° C.) | Upper limit of optimum aging temperature (° C.) | Optimum aging temperature span (° C.) | Maximum coercivity (kA/m) |
|---|---|---|---|---|---|---|---|---|---|
| Example 15-1 | 1.0 | 1.0 | 850 | 950 | 100 | 410 | 550 | 140 | 1,696 |
| Example 15-2 | 3.0 | 2.0 | 850 | 950 | 100 | 410 | 590 | 180 | 1,758 |
| Example 15-3 | 5.0 | 3.0 | 850 | 1,000 | 150 | 470 | 670 | 200 | 1,863 |
| Comparative Example 13 | 0.2 | 0.2 | 850 | 900 | 50 | 430 | 510 | 80 | 1,541 |

It is evident from Table 6 that as compared with Comparative Example 13, the magnet blocks of Example 15 are spread in both the optimum grain boundary diffusion temperature span and the optimum aging treatment temperature span. The coercivity of the magnet blocks of Example 15 is lower than that of Example 14, probably because the anisotropic magnetic field of $Dy_2Fe_{14}B$ is lower than that of $Tb_2Fe_{14}B$.

Example 16 and Comparative Example 14

Like magnet blocks 14-1-1 to 14-1-4, magnet blocks were prepared via heat treatment steps as in Example 14 and Comparative Example 12 except that terbium fluoride (average particle size 1.4 μm) was used instead of terbium oxide. They are designated blocks 16-1-1 to 16-1-4.

Magnet blocks 16-2-1 to 16-2-4 were prepared under the same conditions as above (blocks 16-1-1 to 16-1-4) except that the alloy composition was changed to 3.0 at % Al and 2.0 at % Si. Also, magnet blocks 16-3-1 to 16-3-4 were similarly prepared except that the alloy composition was changed to 5.0 at % Al and 3.0 at % Si. For comparison, magnet blocks 14-1 to 14-4 were similarly prepared except that the alloy composition was changed to 0.2 at % Al and 0.2 at % Si.

The magnet blocks 16-1-1 to 16-3-4 and comparative magnet blocks 14-1 to 14-4 were subjected to aging treatment at a temperature varying from 400° C. to 800° C. at an interval of 20-30° C. for 1 hour. The magnet blocks were measured for coercivity. Of magnet blocks 16-1-1, the block having the maximum coercivity is designated 16-1-1-1. Similarly, of magnet blocks 16-1-2, the block having the maximum coercivity is designated 16-1-2-1; of magnet blocks 16-1-3, the block having the maximum coercivity is designated 16-1-3-1; of magnet blocks 16-1-4, the block having the maximum coercivity is designated 16-1-4-1. Similarly, of magnet blocks 16-2-1 to 16-3-4, the blocks having the maximum coercivity are designated 16-2-1-1 to 16-3-4-1, respectively. Of comparative magnet blocks 14-1, the block having the maximum coercivity is designated 14-1-1; of comparative magnet blocks 14-2, the block having the maximum coercivity is designated 14-2-1; of comparative magnet blocks 14-3, the block having the maximum coercivity is designated 14-3-1; of comparative magnet blocks 14-4, the block having the maximum coercivity is designated 14-4-1.

Table 7 tabulates the lower limit, upper limit and span of optimum grain boundary diffusion treatment temperature, the lower limit, upper limit and span of optimum aging treatment temperature, as well as the maximum coercivity.

It is evident from Table 7 that as compared with Comparative Example 14, the magnet blocks of Example 16 are spread in both the optimum grain boundary diffusion temperature span and the optimum aging treatment temperature span.

Example 17 and Comparative Example 15

Like magnet blocks 14-1-1 to 14-1-4, magnet blocks were prepared via heat treatment steps as in Example 14 and Comparative Example 12 except that terbium oxyfluoride (average particle size 2.1 μm) was used instead of terbium oxide. They are designated blocks 17-1-1 to 17-1-4.

Magnet blocks 17-2-1 to 17-2-4 were prepared under the same conditions as above (blocks 17-1-1 to 17-1-4) except that the alloy composition was changed to 3.0 at % Al and 2.0 at % Si. Also, magnet blocks 17-3-1 to 17-3-4 were similarly prepared except that the alloy composition was changed to 5.0 at % Al and 3.0 at % Si. For comparison, magnet blocks 15-1 to 15-4 were similarly prepared except that the alloy composition was changed to 0.2 at % Al and 0.2 at % Si.

The magnet blocks 17-1-1 to 17-3-4 and comparative magnet blocks 15-1 to 15-4 were subjected to aging treatment at a temperature varying from 400° C. to 800° C. at an interval of 20-30° C. for 1 hour. The magnet blocks were measured for coercivity. Of magnet blocks 17-1-1, the block having the maximum coercivity is designated 17-1-1-1. Similarly, of magnet blocks 17-1-2, the block having the maximum coercivity is designated 17-1-2-1; of magnet blocks 17-1-3, the block having the maximum coercivity is designated 17-1-3-1; of magnet blocks 17-1-4, the block having the maximum coercivity is designated 17-1-4-1. Similarly, of magnet blocks 17-2-1 to 17-3-4, the blocks having the maximum coercivity are designated 17-2-1-1 to 17-3-4-1, respectively. Of comparative magnet blocks 15-1, the block having the maximum coercivity is designated 15-1-1; of comparative magnet blocks 15-2, the block having the maximum coercivity is designated 15-2-1; of comparative magnet blocks 15-3, the block having the maximum coercivity is designated 15-3-1; of comparative magnet blocks 15-4, the block having the maximum coercivity is designated 15-4-1.

Table 8 tabulates the lower limit, upper limit and span of optimum grain boundary diffusion treatment temperature, the lower limit, upper limit and span of optimum aging treatment temperature, as well as the maximum coercivity.

TABLE 7

| Sample | Al (at %) | Si (at %) | Lower limit of optimum diffusion temperature (° C.) | Upper limit of optimum diffusion temperature (° C.) | Optimum diffusion temperature span (° C.) | Lower limit of optimum aging temperature (° C.) | Upper limit of optimum aging temperature (° C.) | Optimum aging temperature span (° C.) | Maximum coercivity (kA/m) |
|---|---|---|---|---|---|---|---|---|---|
| Example 16-1 | 1.0 | 1.0 | 850 | 950 | 100 | 410 | 550 | 140 | 1,982 |
| Example 16-2 | 3.0 | 2.0 | 850 | 950 | 100 | 410 | 590 | 180 | 2,005 |
| Example 16-3 | 5.0 | 3.0 | 850 | 1,000 | 150 | 470 | 670 | 200 | 2,141 |
| Comparative Example 14 | 0.2 | 0.2 | 850 | 900 | 50 | 430 | 510 | 80 | 1,807 |

TABLE 8

| Sample | Al (at %) | Si (at %) | Lower limit of optimum diffusion temperature (° C.) | Upper limit of optimum diffusion temperature (° C.) | Optimum diffusion temperature span (° C.) | Lower limit of optimum aging temperature (° C.) | Upper limit of optimum aging temperature (° C.) | Optimum aging temperature span (° C.) | Maximum coercivity (kA/m) |
|---|---|---|---|---|---|---|---|---|---|
| Example 17-1 | 1.0 | 1.0 | 850 | 950 | 100 | 410 | 550 | 140 | 1,958 |
| Example 17-2 | 3.0 | 2.0 | 850 | 950 | 100 | 410 | 590 | 180 | 1,989 |
| Example 17-3 | 5.0 | 3.0 | 850 | 1,000 | 150 | 470 | 670 | 200 | 2,101 |
| Comparative Example 15 | 0.2 | 0.2 | 850 | 900 | 50 | 430 | 510 | 80 | 1,775 |

It is evident from Table 8 that as compared with Comparative Example 15, the magnet blocks of Example 17 are spread in both the optimum grain boundary diffusion temperature span and the optimum aging treatment temperature span.

Example 18 and Comparative Example 16

Like magnet blocks 14-1-1 to 14-1-4, magnet blocks were prepared via heat treatment steps as in Example 14 and Comparative Example 12 except that terbium hydride (average particle size 6.7 μm) was used instead of terbium oxide and the average coating weight was changed to 35±5 μg/mm$^2$. They are designated blocks 18-1-1 to 18-1-4.

Magnet blocks 18-2-1 to 18-2-4 were prepared under the same conditions as above (blocks 18-1-1 to 18-1-4) except that the alloy composition was changed to 3.0 at % Al and 2.0 at % Si. Also, magnet blocks 18-3-1 to 18-3-4 were similarly prepared except that the alloy composition was changed to 5.0 at % Al and 3.0 at % Si. For comparison, magnet blocks 16-1 to 16-4 were similarly prepared except that the alloy composition was changed to 0.2 at % Al and 0.2 at % Si.

The magnet blocks 18-1-1 to 18-3-4 and comparative magnet blocks 16-1 to 16-4 were subjected to aging treatment at a temperature varying from 400° C. to 800° C. at an interval of 20-30° C. for 1 hour. The magnet blocks were measured for coercivity. Of magnet blocks 18-1-1, the block having the maximum coercivity is designated 18-1-1-1. Similarly, of magnet blocks 18-1-2, the block having the maximum coercivity is designated 18-1-2-1; of magnet blocks 18-1-3, the block having the maximum coercivity is designated 18-1-3-1; of magnet blocks 18-1-4, the block having the maximum coercivity is designated 18-1-4-1. Similarly, of magnet blocks 18-2-1 to 18-3-4, the blocks having the maximum coercivity are designated 18-2-1-1 to 18-3-4-1, respectively. Of comparative magnet blocks 16-1, the block having the maximum coercivity is designated 16-1-1; of comparative magnet blocks 16-2, the block having the maximum coercivity is designated 16-2-1; of comparative magnet blocks 16-3, the block having the maximum coercivity is designated 16-3-1; of comparative magnet blocks 16-4, the block having the maximum coercivity is designated 16-4-1.

Table 9 tabulates the lower limit, upper limit and span of optimum grain boundary diffusion treatment temperature, the lower limit, upper limit and span of optimum aging treatment temperature, as well as the maximum coercivity.

TABLE 9

| Sample | Al (at %) | Si (at %) | Lower limit of optimum diffusion temperature (° C.) | Upper limit of optimum diffusion temperature (° C.) | Optimum diffusion temperature span (° C.) | Lower limit of optimum aging temperature (° C.) | Upper limit of optimum aging temperature (° C.) | Optimum aging temperature span (° C.) | Maximum coercivity (kA/m) |
|---|---|---|---|---|---|---|---|---|---|
| Example 18-1 | 1.0 | 1.0 | 850 | 950 | 100 | 410 | 550 | 140 | 1,918 |
| Example 18-2 | 3.0 | 2.0 | 850 | 950 | 100 | 410 | 590 | 180 | 1,974 |
| Example 18-3 | 5.0 | 3.0 | 850 | 1,000 | 150 | 470 | 670 | 200 | 2,062 |
| Comparative Example 16 | 0.2 | 0.2 | 850 | 900 | 50 | 430 | 510 | 80 | 1,735 |

It is evident from Table 9 that as compared with Comparative Example 16, the magnet blocks of Example 18 are spread in both the optimum grain boundary diffusion temperature span and the optimum aging treatment temperature span.

Example 19 and Comparative Example 17

Like magnet blocks 14-1-1 to 14-1-4, magnet blocks were prepared via heat treatment steps as in Example 14 and Comparative Example 12 except that $Tb_{34}Co_{33}Al_{33}$ alloy (average particle size 10 μm) was used instead of terbium oxide and the average coating weight was changed to 45±5 μg/mm$^2$. They are designated blocks 19-1-1 to 19-1-4.

Magnet blocks 19-2-1 to 19-2-4 were prepared under the same conditions as above (blocks 19-1-1 to 19-1-4) except that the alloy composition was changed to 3.0 at % Al and 2.0 at % Si. Also, magnet blocks 19-3-1 to 19-3-4 were similarly prepared except that the alloy composition was changed to 5.0 at % Al and 3.0 at % Si. For comparison, magnet blocks 17-1 to 17-4 were similarly prepared except that the alloy composition was changed to 0.2 at % Al and 0.2 at % Si.

The magnet blocks 19-1-1 to 19-3-4 and comparative magnet blocks 17-1 to 17-4 were subjected to aging treatment at a temperature varying from 400° C. to 800° C. at an interval of 20-30° C. for 1 hour. The magnet blocks were measured for coercivity. Of magnet blocks 19-1-1, the block having the maximum coercivity is designated 19-1-1-1. Similarly, of magnet blocks 19-1-2, the block having the maximum coercivity is designated 19-1-2-1; of magnet blocks 19-1-3, the block having the maximum coercivity is designated 19-1-3-1; of magnet blocks 19-1-4, the block having the maximum coercivity is designated 19-1-4-1. Similarly, of magnet blocks 19-2-1 to 19-3-4, the blocks having the maximum coercivity are designated 19-2-1-1 to 19-3-4-1, respectively. Of comparative magnet blocks 17-1, the block having the maximum coercivity is designated 17-1-1; of comparative magnet blocks 17-2, the block having the maximum coercivity is designated 17-2-1; of comparative magnet blocks 17-3, the block having the maximum coercivity is designated 17-3-1; of comparative magnet blocks 17-4, the block having the maximum coercivity is designated 17-4-1.

Table 10 tabulates the lower limit, upper limit and span of optimum grain boundary diffusion treatment temperature, the lower limit, upper limit and span of optimum aging treatment temperature, as well as the maximum coercivity.

TABLE 10

| Sample | Al (at %) | Si (at %) | Lower limit of optimum diffusion temperature (° C.) | Upper limit of optimum diffusion temperature (° C.) | Optimum diffusion temperature span (° C.) | Lower limit of optimum aging temperature (° C.) | Upper limit of optimum aging temperature (° C.) | Optimum aging temperature span (° C.) | Maximum coercivity (kA/m) |
|---|---|---|---|---|---|---|---|---|---|
| Example 19-1 | 1.0 | 1.0 | 850 | 950 | 100 | 410 | 550 | 140 | 1,902 |
| Example 19-2 | 3.0 | 2.0 | 850 | 950 | 100 | 410 | 590 | 180 | 1,943 |
| Example 19-3 | 5.0 | 3.0 | 850 | 1,000 | 150 | 470 | 670 | 200 | 2,046 |
| Comparative Example 17 | 0.2 | 0.2 | 850 | 900 | 50 | 430 | 510 | 80 | 1,751 |

It is evident from Table 10 that as compared with Comparative Example 17, the magnet blocks of Example 19 are spread in both the optimum grain boundary diffusion temperature span and the optimum aging treatment temperature span.

Example 20 and Comparative Example 18

A ribbon form alloy consisting of 14.5 at % Nd, 0.2 at % Cu, 6.2 at % B, 1.0 at % Al, 1.0 at % Si, and the balance of Fe were prepared by the strip casting technique, specifically by using Nd, Al, Fe and Cu metals having a purity of at least 99 wt %, Si having a purity of 99.99 wt %, and ferroboron, high-frequency heating in an Ar atmosphere for melting, and casting the melt onto a single chill roll of copper. The alloy was exposed to 0.11 MPa of hydrogen at room temperature so that hydrogen was absorbed therein, heated up to 500° C. while vacuum pumping so that hydrogen was partially desorbed, cooled, and sieved, collecting a coarse powder under 50 mesh.

The coarse powder was finely pulverized on a jet mill using high pressure nitrogen gas, into a fine powder having a median diameter of 5 μm. The fine powder was compacted under a pressure of about 1 ton/cm$^2$ in a nitrogen atmosphere while being oriented in a magnetic field of 15 kOe. The green compact was then placed in a sintering furnace where it was sintered in argon atmosphere at 1,060° C. for 2 hours, obtaining a sintered magnet block. Using a diamond cutter, the sintered block was ground on entire surfaces into a block of 15 mm×15 mm×3 mm thick. It was successively cleaned with alkaline solution, deionized water, nitric acid, and deionized water, and dried, yielding a magnet block.

Dy metal was placed in an alumina boat (inner diameter 40 mm, height 25 mm), which was placed in a molybdenum container (internal dimensions 50 mm×100 mm×40 mm) along with the magnet block. The container was put in a controlled atmosphere furnace where heat treatment was performed at 850° C., 900° C., 950° C. or 1,000° C. for 5 hours in a vacuum atmosphere which was established by a rotary pump and diffusion pump. On subsequent cooling to room temperature, diffusion treated magnet blocks were obtained, designated 20-1-1 to 20-1-4.

Magnet blocks 20-2-1 to 20-2-4 were prepared under the same conditions as above (blocks 20-1-1 to 20-1-4) except that the alloy composition was changed to 3.0 at % Al and 2.0 at % Si. Also, magnet blocks 20-3-1 to 20-3-4 were similarly prepared except that the alloy composition was changed to 5.0 at % Al and 3.0 at % Si. For comparison, magnet blocks 18-1 to 18-4 were similarly prepared except that the alloy composition was changed to 0.2 at % Al and 0.2 at % Si.

The magnet blocks 20-1-1 to 20-3-4 and comparative magnet blocks 18-1 to 18-4 were subjected to aging treatment at a temperature varying from 400° C. to 800° C. at an interval of 20-30° C. for 1 hour. The magnet blocks were measured for coercivity. Of magnet blocks 20-1-1, the block having the maximum coercivity is designated 20-1-1-1. Similarly, of magnet blocks 20-1-2, the block having the maximum coercivity is designated 20-1-2-1; of magnet blocks 20-1-3, the block having the maximum coercivity is designated 20-1-3-1; of magnet blocks 20-1-4, the block having the maximum coercivity is designated 20-1-4-1. Similarly, of magnet blocks 20-2-1 to 20-3-4, the blocks having the maximum coercivity are designated 20-2-1-1 to 20-3-4-1, respectively. Of comparative magnet blocks 18-1, the block having the maximum coercivity is designated 18-1-1; of comparative magnet blocks 18-2, the block having the maximum coercivity is designated 18-2-1; of comparative magnet blocks 18-3, the block having the maximum coercivity is designated 18-3-1; of comparative magnet blocks 18-4, the block having the maximum coercivity is designated 18-4-1.

Table 11 tabulates the lower limit, upper limit and span of optimum grain boundary diffusion treatment temperature, the lower limit, upper limit and span of optimum aging treatment temperature, as well as the maximum coercivity.

TABLE 11

| Sample | Al (at %) | Si (at %) | Lower limit of optimum diffusion temperature (° C.) | Upper limit of optimum diffusion temperature (° C.) | Optimum diffusion temperature span (° C.) | Lower limit of optimum aging temperature (° C.) | Upper limit of optimum aging temperature (° C.) | Optimum aging temperature span (° C.) | Maximum coercivity (kA/m) |
|---|---|---|---|---|---|---|---|---|---|
| Example 20-1 | 1.0 | 1.0 | 850 | 950 | 100 | 410 | 550 | 140 | 1,670 |
| Example 20-2 | 3.0 | 2.0 | 850 | 950 | 100 | 410 | 590 | 180 | 1,742 |
| Example 20-3 | 5.0 | 3.0 | 850 | 1,000 | 150 | 470 | 670 | 200 | 1,847 |
| Comparative Example 18 | 0.2 | 0.2 | 850 | 900 | 50 | 430 | 510 | 80 | 1,519 |

It is evident from Table 11 that as compared with Comparative Example 18, the magnet blocks of Example 20 are spread in both the optimum grain boundary diffusion temperature span and the optimum aging treatment temperature span.

Example 21 and Comparative Example 19

Like magnet blocks 18-1-1 to 18-1-4, magnet blocks were prepared via heat treatment steps as in Example 18 and Comparative Example 16 except that $Dy_{34}Fe_{66}$ alloy (at %) was used instead of Dy metal. They are designated blocks 21-1-1 to 21-1-4.

Magnet blocks 21-2-1 to 21-2-4 were prepared under the same conditions as above (blocks 21-1-1 to 21-1-4) except that the alloy composition was changed to 3.0 at % Al and 2.0 at % Si. Also, magnet blocks 21-3-1 to 21-3-4 were similarly prepared except that the alloy composition was changed to 5.0 at % Al and 3.0 at % Si. For comparison, magnet blocks 19-1 to 19-4 were similarly prepared except that the alloy composition was changed to 0.2 at % Al and 0.2 at % Si.

The magnet blocks 21-1-1 to 21-3-4 and comparative magnet blocks 19-1 to 19-4 were subjected to aging treatment at a temperature varying from 400° C. to 800° C. at an interval of 20-30° C. for 1 hour. The magnet blocks were measured for coercivity. Of magnet blocks 21-1-1, the block having the maximum coercivity is designated 21-1-1-1. Similarly, of magnet blocks 21-1-2, the block having the maximum coercivity is designated 21-1-2-1; of magnet blocks 21-1-3, the block having the maximum coercivity is designated 21-1-3-1; of magnet blocks 21-1-4, the block having the maximum coercivity is designated 21-1-4-1. Similarly, of magnet blocks 21-2-1 to 21-3-4, the blocks having the maximum coercivity are designated 21-2-1-1 to 21-3-4-1, respectively. Of comparative magnet blocks 19-1, the block having the maximum coercivity is designated 19-1-1; of comparative magnet blocks 19-2, the block having the maximum coercivity is designated 19-2-1; of comparative magnet blocks 19-3, the block having the maximum coercivity is designated 19-3-1; of comparative magnet blocks 19-4, the block having the maximum coercivity is designated 19-4-1.

Table 12 tabulates the lower limit, upper limit and span of optimum grain boundary diffusion treatment temperature, the lower limit, upper limit and span of optimum aging treatment temperature, as well as the maximum coercivity.

TABLE 12

| Sample | Al (at %) | Si (at %) | Lower limit of optimum diffusion temperature (° C.) | Upper limit of optimum diffusion temperature (° C.) | Optimum diffusion temperature span (° C.) | Lower limit of optimum aging temperature (° C.) | Upper limit of optimum aging temperature (° C.) | Optimum aging temperature span (° C.) | Maximum coercivity (kA/m) |
|---|---|---|---|---|---|---|---|---|---|
| Example 21-1 | 1.0 | 1.0 | 850 | 950 | 100 | 410 | 550 | 140 | 1,679 |
| Example 21-2 | 3.0 | 2.0 | 850 | 950 | 100 | 410 | 590 | 180 | 1,712 |
| Example 21-3 | 5.0 | 3.0 | 850 | 1,000 | 150 | 470 | 670 | 200 | 1,823 |
| Comparative Example 19 | 0.2 | 0.2 | 850 | 900 | 50 | 430 | 510 | 80 | 1,504 |

It is evident from Table 12 that as compared with Comparative Example 19, the magnet blocks of Example 21 are spread in both the optimum grain boundary diffusion temperature span and the optimum aging treatment temperature span.

Example 22 and Comparative Example 20

A ribbon form alloy consisting of 12.5 at % Nd, 2.0 at % Pr, 1.2 at % Al, 0.4 at % Cu, 5.5 at % B, 1.3 at % Si, and the balance of Fe was prepared by the strip casting technique, specifically by using Nd, Pr, Al, Fe and Cu metals having a purity of at least 99 wt %, Si having a purity of 99.99 wt %, and ferroboron, high-frequency heating in an Ar atmosphere for melting, and casting the melt onto a single chill roll of copper. This was followed by the same procedure as in Example 14, yielding a magnet block of 15 mm×15 mm×3 mm thick.

Next, the magnet block was immersed for 30 seconds in a slurry of terbium oxide powder in ethanol at a weight fraction of 50%. The terbium oxide powder had an average particle size of 0.15 μm. The magnet block was taken out, allowed to drain and dried under hot air blow. The average coating weight of powder was 50±5 $\mu g/mm^2$. The immersion and drying steps were repeated, if necessary, until the desired coating weight was reached.

The magnet block covered with terbium oxide was heat treated in Ar atmosphere at 850° C., 900° C., 950° C. or 1,000° C. for 5 hours and then cooled to room temperature, yielding a diffusion treated magnet block. These magnet blocks are designated inventive magnet blocks 22-1 to 22-4.

For comparison, comparative magnet blocks 20-1 to 20-4 were prepared by the same procedure as above (blocks 22-1 to 22-4) aside from using a ribbon form alloy consisting of 12.5 at % Nd, 2.0 at % Pr, 0.4 at % Cu, 0.2 at % Al, 0.2 at % Si, 6.1 at % B, and the balance of Fe.

The magnet blocks 22-1 to 22-4 and comparative magnet blocks 20-1 to 20-4 were subjected to aging treatment at a temperature varying from 400° C. to 800° C. at an interval of 20-30° C. for 1 hour. The magnet blocks were measured for coercivity. Of magnet blocks 22-1, the block having the maximum coercivity is designated 22-1-1. Similarly, of magnet blocks 22-2 to 22-4, the blocks having the maximum coercivity are designated 22-2-1 to 22-4-1, respectively. Of comparative magnet blocks 20-1, the block having the maximum coercivity is designated 20-1-1; of comparative magnet blocks 20-2, the block having the maximum coercivity is designated 20-2-1; of comparative magnet blocks 20-3, the block having the maximum coercivity is designated 20-3-1; of comparative magnet blocks 20-4, the block having the maximum coercivity is designated 20-4-1.

Table 13 tabulates the lower limit, upper limit and span of optimum grain boundary diffusion treatment temperature, the lower limit, upper limit and span of optimum aging treatment temperature, as well as the maximum coercivity.

TABLE 13

| Sample | Al (at %) | Si (at %) | Lower limit of optimum diffusion temperature (° C.) | Upper limit of optimum diffusion temperature (° C.) | Optimum diffusion temperature span (° C.) | Lower limit of optimum aging temperature (° C.) | Upper limit of optimum aging temperature (° C.) | Optimum aging temperature span (° C.) | Maximum coercivity (kA/m) |
|---|---|---|---|---|---|---|---|---|---|
| Example 22-1 | 1.0 | 1.0 | 850 | 950 | 100 | 410 | 550 | 140 | 2,133 |
| Example 22-2 | 3.0 | 2.0 | 850 | 950 | 100 | 430 | 600 | 170 | 2,211 |
| Example 22-3 | 5.0 | 3.0 | 850 | 1,000 | 150 | 480 | 690 | 210 | 2,320 |
| Comparative Example 20 | 0.2 | 0.2 | 850 | 900 | 50 | 430 | 510 | 80 | 1,872 |

It is evident from Table 13 that as compared with Comparative Example 20, the magnet blocks of Example 22 are spread in both the optimum grain boundary diffusion temperature span and the optimum aging treatment temperature span.

Example 23 and Comparative Example 21

Magnet blocks 23-1 to 23-4 were prepared by the same procedure as in Example 22 (blocks 22-1 to 22-4) aside from using a ribbon form alloy consisting of 13.0 at % Nd, 1.5 at % Dy, 1.5 at % Co, 1.0 at % Si, 1.3 at % Al, 5.8 at % B, and the balance of Fe.

Comparative magnet blocks 21-1 to 21-4 were prepared by the same procedure as in Comparative Example 20 (blocks 20-1 to 20-4) aside from using a ribbon form alloy consisting of 13.0 at % Nd, 1.5 at % Dy, 1.5 at % Co, 0.2 at % Si, 0.2 at % Al, 5.8 at % B, and the balance of Fe.

The magnet blocks 23-1 to 23-4 and comparative magnet blocks 21-1 to 21-4 were subjected to aging treatment at a temperature varying from 400° C. to 800° C. at an interval of 20-30° C. for 1 hour. The magnet blocks were measured for coercivity. Of magnet blocks 23-1, the block having the maximum coercivity is designated 23-1-1. Similarly, of magnet blocks 23-2 to 23-4, the blocks having the maximum coercivity are designated 23-2-1 to 23-4-1, respectively. Of comparative magnet blocks 21-1, the block having the maximum coercivity is designated 21-1-1; of comparative magnet blocks 21-2, the block having the maximum coercivity is designated 21-2-1; of comparative magnet blocks 21-3, the block having the maximum coercivity is designated 21-3-1; of comparative magnet blocks 21-4, the block having the maximum coercivity is designated 21-4-1.

Table 14 tabulates the lower limit, upper limit and span of optimum grain boundary diffusion treatment temperature, the lower limit, upper limit and span of optimum aging treatment temperature, as well as the maximum coercivity.

TABLE 14

| Sample | Al (at %) | Si (at %) | Lower limit of optimum diffusion temperature (° C.) | Upper limit of optimum diffusion temperature (° C.) | Optimum diffusion temperature span (° C.) | Lower limit of optimum aging temperature (° C.) | Upper limit of optimum aging temperature (° C.) | Optimum aging temperature span (° C.) | Maximum coercivity (kA/m) |
|---|---|---|---|---|---|---|---|---|---|
| Example 23-1 | 1.0 | 1.0 | 850 | 950 | 100 | 410 | 550 | 140 | 2,280 |
| Example 23-2 | 3.0 | 2.0 | 850 | 950 | 100 | 430 | 600 | 170 | 2,364 |
| Example 23-3 | 5.0 | 3.0 | 850 | 1,000 | 150 | 480 | 690 | 210 | 2,480 |
| Comparative Example 21 | 0.2 | 0.2 | 850 | 900 | 50 | 430 | 510 | 80 | 1,898 |

It is evident from Table 14 that as compared with Comparative Example 21, the magnet blocks of Example 23 are spread in both the optimum grain boundary diffusion temperature span and the optimum aging treatment temperature span. A coercivity enhancement effect is also acknowledged when Dy is previously contained in the mother alloy.

Example 24 and Comparative Example 22

A ribbon form alloy consisting of 12.0 at % Nd, 2.0 at % Pr, 0.5 at % Ce, x at % Al (wherein x=0.5 to 8.0), x at % Al (wherein x=0.5 to 6.0), 0.5 at % Cu, y at % M (wherein y=0.05 to 2.0 (see Table 12), M is Ti, V, Cr, Mn, Ni, Ga, Ge, Zr, Nb, Mo, Ag, Sn, Sb, Hf, Ta or W), 6.2 at % B, and the balance of Fe was prepared by the strip casting technique, specifically by using Nd, Pr, Ce, Al, Fe, Cu, Ti, V, Cr, Mn, Ni, Ga, Ge, Zr, Nb, Mo, Ag, Sn, Sb, Hf, Ta and W metals having a purity of at least 99 wt %, Si having a purity of 99.99 wt %, and ferroboron, high-frequency heating in an Ar atmosphere for melting, and casting the melt onto a single chill roll of copper. The alloy was exposed to 0.11 MPa of hydrogen at room temperature so that hydrogen was absorbed therein, heated up to 500° C. while vacuum pumping so that hydrogen was partially desorbed, cooled, and sieved, collecting a coarse powder under 50 mesh.

The coarse powder was finely pulverized on a jet mill using high pressure nitrogen gas, into a fine powder having a median diameter of 5.2 μm. The fine powder was compacted under a pressure of about 1 ton/cm$^2$ in a nitrogen atmosphere while being oriented in a magnetic field of 15 kOe. The green compact was then placed in a sintering furnace where it was sintered in argon atmosphere at 1,060° C. for 2 hours, obtaining a sintered magnet block. Using a diamond cutter, the sintered block was ground on entire surfaces into a block of 7 mm×7 mm×2.5 mm thick. It was successively cleaned with alkaline solution, deionized water, citric acid, and deionized water, and dried, yielding a magnet block.

Next, the magnet block was immersed for 30 seconds in a slurry of a 50:50 (weight ratio) terbium fluoride/terbium oxide powder mixture in ethanol at a weight fraction of 50%. The terbium fluoride powder and terbium oxide powder had an average particle size of 1.4 μm and 0.15 μm, respectively. The magnet block was taken out, allowed to drain, and dried under hot air blow. The average coating weight of powder was 30±5 μg/mm$^2$. The immersion and drying steps were repeated, if necessary, until the desired coating weight was reached.

The magnet block covered with terbium fluoride/terbium oxide was subjected to diffusion treatment in Ar atmosphere at 850 to 1,000° C. for 15 hours and then to aging treatment at 400 to 800° C. for 1 hour, and quenched, yielding a diffusion treated magnet block. Of these magnet blocks, those blocks having at least 0.3 at % of aluminum and silicon added thereto are designated inventive magnet blocks A24-1 to A24-16 in the order of the additive element M=Ti, V, Cr, Mn, Ni, Ga, Ge, Zr, Nb, Mo, Ag, Sn, Sb, Hf, Ta, and W. Those blocks having 0.2 at % of aluminum and silicon for comparison are similarly designated comparative magnet blocks B22-1 to B22-16.

Table 15 tabulates the average coating weight and magnetic properties of magnet blocks A24-1 to A24-16 and B22-1 to B22-16. As compared with the magnet blocks of identical M having less than 0.3 at % of aluminum and silicon added thereto, inventive magnet blocks A24-1 to A24-16 exhibit higher values of coercivity.

For magnet blocks A24-1 to A24-16 and B22-1 to B22-16, Table 16 tabulates the optimum diffusion treatment temperature and optimum aging treatment temperature in the consecutive heat treatment temperature region giving a coercivity value corresponding to at least 94% of the peak coercivity Hp, the optimum diffusion treatment temperature span and optimum aging treatment temperature span, along with the diffusion temperature and aging temperature giving the peak coercivity Hp. A comparison with the magnet blocks of identical M having less than 0.3 at % of aluminum and silicon added thereto reveals that both the optimum diffusion treatment temperature span and the optimum aging treatment temperature span are spread to the high temperature side as the contents of aluminum and silicon are increased.

It is thus concluded that the addition of 0.3 to 10 at % of aluminum and 0.3 to 7 at % of silicon to the mother alloy helps promote the coercivity enhancement effect of grain boundary diffusion treatment so that higher magnetic properties may be developed. In addition, the diffusion temperature and aging temperature can be spread to the high temperature side.

TABLE 15

| | | Al content, x | Si content, x | M | M content, y | Average coating weight (μg/mm$^2$) | Maximum coercivity Hp (kA/m) |
|---|---|---|---|---|---|---|---|
| Example 24 | A24-1 | 0.5 | 0.5 | Ti | 0.2 | 28 | 1,920 |
| | A24-2 | 0.5 | 0.5 | V | 0.5 | 33 | 1,893 |
| | A24-3 | 1.0 | 1.0 | Cr | 1.5 | 34 | 1,992 |
| | A24-4 | 1.0 | 1.0 | Mn | 1.5 | 29 | 1,995 |
| | A24-5 | 1.0 | 2.0 | Ni | 2.0 | 28 | 2,056 |
| | A24-6 | 2.0 | 3.0 | Ga | 0.2 | 31 | 2,086 |
| | A24-7 | 2.0 | 3.0 | Ge | 0.8 | 34 | 2,091 |
| | A24-8 | 2.0 | 3.0 | Zr | 0.2 | 32 | 2,074 |
| | A24-9 | 4.0 | 3.0 | Nb | 0.4 | 29 | 2,152 |
| | A24-10 | 4.0 | 5.0 | Mo | 0.3 | 26 | 2,166 |
| | A24-11 | 4.0 | 5.0 | Ag | 0.3 | 30 | 2,173 |
| | A24-12 | 6.0 | 5.0 | Sn | 0.5 | 34 | 2,203 |
| | A24-13 | 6.0 | 5.0 | Sb | 0.5 | 32 | 2,197 |
| | A24-14 | 6.0 | 6.0 | Hf | 0.2 | 29 | 2,231 |
| | A24-15 | 8.0 | 6.0 | Ta | 0.1 | 26 | 2,211 |
| | A24-16 | 8.0 | 6.0 | W | 0.05 | 31 | 2,206 |
| Comparative | B22-1 | 0.2 | 0.2 | Ti | 0.2 | 27 | 1,712 |
| Example 22 | B22-2 | 0.2 | 0.2 | V | 0.5 | 31 | 1,705 |

TABLE 15-continued

| | Al content, x | Si content, x | M | M content, y | Average coating weight (μg/mm²) | Maximum coercivity Hp (kA/m) |
|---|---|---|---|---|---|---|
| B22-3 | 0.2 | 0.2 | Cr | 1.5 | 26 | 1,738 |
| B22-4 | 0.2 | 0.2 | Mn | 1.5 | 33 | 1,725 |
| B22-5 | 0.2 | 0.2 | Ni | 2.0 | 29 | 1,752 |
| B22-6 | 0.2 | 0.2 | Ga | 0.2 | 31 | 1,726 |
| B22-7 | 0.2 | 0.2 | Ge | 0.8 | 34 | 1,733 |
| B22-8 | 0.2 | 0.2 | Zr | 0.2 | 27 | 1,718 |
| B22-9 | 0.2 | 0.2 | Nb | 0.4 | 26 | 1,724 |
| B22-10 | 0.2 | 0.2 | Mo | 0.3 | 34 | 1,721 |
| B22-11 | 0.2 | 0.2 | Ag | 0.3 | 31 | 1,733 |
| B22-12 | 0.2 | 0.2 | Sn | 0.5 | 25 | 1,708 |
| B22-13 | 0.2 | 0.2 | Sb | 0.5 | 34 | 1,689 |
| B22-14 | 0.2 | 0.2 | Hf | 0.2 | 33 | 1,729 |
| B22-15 | 0.2 | 0.2 | Ta | 0.1 | 28 | 1,716 |
| B22-16 | 0.2 | 0.2 | W | 0.05 | 34 | 1,708 |

TABLE 16

| | | Optimum diffusion temperature (° C.) | Optimum aging temperature (° C.) | Optimum diffusion temperature span (° C.) | Optimum aging temperature span (° C.) | Diffusion temperature giving maximum coercivity Hp (° C.) | Aging temperature giving maximum coercivity Hp (° C.) |
|---|---|---|---|---|---|---|---|
| Example 24 | A24-1 | 850-930 | 430-530 | 80 | 100 | 880 | 480 |
| | A24-2 | 850-930 | 430-530 | 80 | 100 | 880 | 490 |
| | A24-3 | 850-950 | 410-550 | 100 | 140 | 900 | 510 |
| | A24-4 | 850-950 | 410-550 | 100 | 140 | 900 | 510 |
| | A24-5 | 850-950 | 410-570 | 100 | 160 | 900 | 530 |
| | A24-6 | 850-950 | 410-590 | 100 | 180 | 900 | 530 |
| | A24-7 | 850-950 | 410-590 | 100 | 180 | 900 | 550 |
| | A24-8 | 850-950 | 410-590 | 100 | 180 | 900 | 540 |
| | A24-9 | 850-950 | 430-630 | 100 | 200 | 900 | 550 |
| | A24-10 | 850-1,000 | 450-650 | 150 | 200 | 950 | 580 |
| | A24-24 | 850-1,000 | 450-650 | 150 | 200 | 950 | 580 |
| | A24-12 | 850-1,000 | 470-690 | 150 | 220 | 950 | 620 |
| | A24-13 | 850-1,000 | 470-690 | 150 | 220 | 950 | 630 |
| | A24-14 | 850-1,000 | 470-690 | 150 | 220 | 950 | 620 |
| | A24-15 | 850-1,000 | 470-710 | 150 | 240 | 950 | 630 |
| | A24-16 | 850-1,000 | 470-710 | 150 | 240 | 950 | 630 |
| Comparative Example 22 | B22-1 | 850-900 | 430-510 | 50 | 80 | 850 | 460 |
| | B22-2 | 850-900 | 430-510 | 50 | 80 | 850 | 460 |
| | B22-3 | 850-900 | 430-510 | 50 | 80 | 850 | 470 |
| | B22-4 | 850-900 | 430-510 | 50 | 80 | 850 | 470 |
| | B22-5 | 850-900 | 430-510 | 50 | 80 | 850 | 480 |
| | B22-6 | 850-900 | 430-510 | 50 | 80 | 850 | 460 |
| | B22-7 | 850-900 | 430-510 | 50 | 80 | 850 | 480 |
| | B22-8 | 850-900 | 450-510 | 50 | 60 | 850 | 480 |
| | B22-9 | 850-900 | 450-510 | 50 | 60 | 850 | 480 |
| | B22-10 | 850-900 | 430-510 | 50 | 80 | 850 | 470 |
| | B22-22 | 850-900 | 430-510 | 50 | 80 | 850 | 460 |
| | B22-12 | 850-900 | 430-510 | 50 | 80 | 850 | 460 |
| | B22-13 | 850-900 | 430-510 | 50 | 80 | 850 | 480 |
| | B22-14 | 850-900 | 450-510 | 50 | 60 | 850 | 480 |
| | B22-15 | 850-900 | 450-510 | 50 | 60 | 850 | 480 |
| | B22-16 | 850-900 | 450-510 | 50 | 60 | 850 | 480 |

Japanese Patent Application Nos. 2012-090070, 2012-090078 and 2012-090099 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a rare earth sintered magnet, comprising the steps of:

providing an anisotropic sintered body comprising $Nd_2Fe_{14}B$ crystal phase as primary phase and having the composition $R^1{}_aT_bM_cAl_fSi_dB_e$ wherein $R^1$ is at least one element selected from rare earth elements inclusive of Sc and Y, T is one or both of Fe and Co, M is at least one element selected from the group consisting of Cu, Zn, In, P, S, Ti, V, Cr, Mn, Ni, Ga, Ge, Zr, Nb, Mo, Pd, Ag, Cd, Sn, Sb, Hf, Ta, and W, Al is aluminum, Si is silicon, B is boron, "a" to "f" indicative of atomic percent in the alloy are in the range: $12 \leq a \leq 17$, $0 \leq c \leq 5$, $0.3 \leq f \leq 10$, $0.3 \leq d \leq 7$, $5 \leq e \leq 10$, and the balance of b, and diffusing element $R^2$ into the sintered body from its surface at a temperature lower than or equal to the sintering temperature of the sintered body, wherein $R^2$ is one or both of Dy and Tb.

2. The method of claim 1 wherein the diffusion temperature is 800 to 1,050° C.

3. The method of claim 2 wherein the diffusion temperature is 850 to 1,000° C.

4. The method of claim 1, further comprising the step of effecting aging treatment after the step of causing element $R^2$ to diffuse into the sintered body.

5. The method of claim 4 wherein the aging treatment is at a temperature of 400 to 800° C.

6. The method of claim 5 wherein the aging treatment is at a temperature of 450 to 750° C.

7. The method of claim 1 wherein $R^1$ contains at least 80 at % of Nd and/or Pr.

8. The method of claim 1 wherein T contains at least 85 at % of Fe.

* * * * *